US009742074B2

(12) United States Patent
Liu et al.

(10) Patent No.: US 9,742,074 B2
(45) Date of Patent: Aug. 22, 2017

(54) CASSEGRAIN-TYPE METAMATERIAL ANTENNA

(71) Applicant: KUANG-CHI INNOVATIVE TECHNOLOGY LTD., Shenzhen (CN)

(72) Inventors: Ruopeng Liu, Shenzhen (CN); Chunlin Ji, Shenzhen (CN); Yutao Yue, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 192 days.

(21) Appl. No.: 14/607,463

(22) Filed: Jan. 28, 2015

(65) Prior Publication Data

US 2015/0138029 A1 May 21, 2015

Related U.S. Application Data

(63) Continuation of application No. PCT/CN2013/080576, filed on Jul. 31, 2013.

(30) Foreign Application Priority Data

Jul. 31, 2012 (CN) ..... 2012 1 0268461
Jul. 31, 2012 (CN) ..... 2012 1 0268552
(Continued)

(51) Int. Cl.

| | |
|---|---|
| ***H01Q 13/00*** | (2006.01) |
| ***H01Q 19/18*** | (2006.01) |
| ***H01Q 19/19*** | (2006.01) |
| ***H01Q 13/02*** | (2006.01) |
| ***H01Q 15/00*** | (2006.01) |

(52) U.S. Cl.
CPC ..... *H01Q 19/18* (2013.01); *H01Q 13/0208* (2013.01); *H01Q 15/0086* (2013.01); *H01Q 19/19* (2013.01)

(58) Field of Classification Search
CPC ..... H01Q 15/02; H01Q 19/065
(Continued)

(56) References Cited

U.S. PATENT DOCUMENTS 4,851,858 A 7/1989 Frisch

FOREIGN PATENT DOCUMENTS

CN 2408577 Y 11/2000
CN 1525599 A 9/2004
(Continued)

OTHER PUBLICATIONS

Wenxuan Tang et al. "Discrete Coordinate Transformation for Designing All-Dielectric Flat Antennas", IEEE Transactions on Antennas and Propagation, vol. 58, No. 12, Dec. 1, 2010 (Dec. 1, 2010), pp. 3795-3804, XP055204372, ISSN: 0018-926X.

*Primary Examiner* — Hoang Nguyen
*Assistant Examiner* — Jae Kim
(74) *Attorney, Agent, or Firm* — Perkins Coie LLP

(57) ABSTRACT

A Cassegrain-type metamaterial antenna, includes: a metamaterial main reflector having a central through-hole, a feed source disposed in the central through-hole, and a sub-reflector disposed in front of the feed source, where an electromagnetic wave radiated by the feed source is emerged in a form of a plane wave after being reflected by the sub-reflector and the metamaterial main reflector in sequence; the metamaterial main reflector includes: a first core layer and a first reflection layer disposed on a rear surface of the first core layer, where the first core layer includes at least one first core layer lamella, and the first core layer lamella includes: a first base material and multiple first conductive geometric structures disposed on the first base material; and a far focus of the sub-reflector coincides with a phase center of the feed source. A paraboloid is replaced with a lamellar metamaterial main reflector.

15 Claims, 12 Drawing Sheets

(30) Foreign Application Priority Data

Jul. 31, 2012 (CN) ..... 2012 1 0268554
Jul. 31, 2012 (CN) ..... 2012 1 0269062

(58) Field of Classification Search
USPC ..... 343/753, 909, 757, 761, 782; 375/338; 250/339.05, 482.1, 503.1; 359/642, 620, 359/321, 341.32, 586, 652
See application file for complete search history.

(56) References Cited

FOREIGN PATENT DOCUMENTS

| | | | |
|---|---|---|---|
| CN | 102480024 | A | 5/2012 |
| CN | 102480030 | A | 5/2012 |
| CN | 102480032 | A | 5/2012 |
| CN | 102480033 | A | 5/2012 |
| CN | 102480064 | A | 5/2012 |
| CN | 102480065 | A | 5/2012 |
| CN | 102544745 | A | 7/2012 |
| CN | 102593594 | A | 7/2012 |
| CN | 102593606 | A | 7/2012 |
| CN | 102800994 | A | 11/2012 |
| CN | 102800995 | A | 11/2012 |
| CN | 102810767 | A | 12/2012 |
| CN | 102820555 | A | 12/2012 |
| CN | 102856664 | A | 1/2013 |
| CN | 103036064 | A | 4/2013 |
| CN | 103036065 | A | 4/2013 |
| EP | 2772988 | A1 | 9/2014 |
| WO | 2011014919 | A1 | 2/2011 |

CASSEGRAIN-TYPE METAMATERIAL ANTENNA

CROSS REFERENCE TO RELATED APPLICATIONS

This application is a continuation of PCT/CN2013/080576 filed on Jul. 31, 2013, which claims priority to CN Patent Application No. 201210269062.3 of Jul. 31, 2012; CN Patent Application No. 201210268552.1 of Jul. 31, 2012; CN Patent Application No. 201210268554.0 of Jul. 31, 2012; and CN Patent Application No. 201210268461.8 of Jul. 31, 2012; all of which are incorporated here in by reference.

TECHNICAL FIELD

The present application relates to the field of communications, and more specifically, to a Cassegrain-type metamaterial antenna.

BACKGROUND

A Cassegrain antenna consists of three parts, namely, a main reflector, a sub-reflector, and a radiation source. The main reflector is a rotating paraboloid reflector, and the sub-reflector is a rotating hyperboloid reflector. In structure, one focus of a hyperboloid coincides with that of a paraboloid, and the focal axis of the hyperboloid coincides with that of the paraboloid, and a radiation source is located on the other focus of the hyperboloid. The sub-reflector reflects an electromagnetic wave, radiated by the radiation source, to the main reflector, and then the main reflector reflects back the electromagnetic wave to obtain a plane wave beam of a corresponding direction, so as to implement directional transmission.

It can be seen that, a main reflector of a conventional Cassegrain antenna needs to be processed to a highly precise paraboloid. However, such processing to a highly precise paraboloid features great difficulty and relatively high costs.

SUMMARY

A technical issue to be solved by embodiments of the disclosure is to provide, aiming at a defect of difficult processing and high costs of a present Cassegrain antenna, a Cassegrain-type metamaterial antenna featuring simple processing and low manufacturing costs.

According to a first aspect of the disclosure, a Cassegrain-type metamaterial antenna is provided, including: a metamaterial main reflector having a central through-hole, a feed source disposed in the central through-hole, and a sub-reflector disposed in front of the feed source, where an electromagnetic wave radiated by the feed source is emerged in a form of a plane wave after being reflected by the sub-reflector and the metamaterial main reflector in sequence; the metamaterial main reflector includes: a first core layer and a first reflection layer disposed on a rear surface of the first core layer, where the first core layer includes at least one first core layer lamella, and the first core layer lamella includes: a first base material and multiple first conductive geometric structures disposed on the first base material; and a far focus of the sub-reflector coincides with a phase center of the feed source.

Preferably, a near focus of the sub-reflector coincides with a focus of the metamaterial main reflector.

Preferably, the sub-reflector is a curved surface of a rotating two-sheet hyperboloid.

Preferably, the sub-reflector is a curved surface of a rotating ellipsoid.

Preferably, the sub-reflector is a metamaterial sub-reflector, the metamaterial sub-reflector includes a second core layer and a second reflection layer disposed on a rear surface of the second core layer, where the second core layer includes at least one second core layer lamella, and the second core layer lamella includes a second base material and multiple second conductive geometric structures disposed on the second base material, and the metamaterial sub-reflector has an electromagnetic wave reflection characteristic similar to that of a rotating two-sheet hyperboloid.

Preferably, the sub-reflector is a metamaterial sub-reflector, the metamaterial sub-reflector includes a second core layer and a second reflection layer disposed on a rear surface of the second core layer, where the second core layer includes at least one second core layer lamella, and the second core layer lamella includes a second base material and multiple second conductive geometric structures disposed on the second base material, and the metamaterial sub-reflector has an electromagnetic wave reflection characteristic similar to that of a rotating ellipsoid.

Preferably, a real axis of the rotating two-sheet hyperboloid or the rotating ellipsoid is perpendicular to the metamaterial main reflector.

Preferably, a central axis of the metamaterial sub-reflector coincides with a central axis of the metamaterial main reflector.

Preferably, the feed source is a corrugated horn, and the real axis passes through a center of an aperture of the corrugated horn.

Preferably, the feed source is a corrugated horn, and the central axis of the metamaterial sub-reflector passes through a center of an aperture of the corrugated horn.

Preferably, when the sub-reflector is a metamaterial sub-reflector, and the metamaterial sub-reflector has an electromagnetic wave reflection characteristic similar to that of a rotating two-sheet hyperboloid, refractive index distribution of any one of the second core layer lamella meets the following formulas:

$$n(r) = n_{max2} - \frac{\sqrt{r^2 + a^2} + \sqrt{r^2 + b^2} - (a + b + k\lambda)}{2d_2};$$

$$d_2 = \frac{\lambda}{2(n_{max2} - n_{min2})};$$

$$k = \text{floor}\left(\frac{\sqrt{r^2 + a^2} + \sqrt{r^2 + b^2} - (a + b)}{\lambda}\right);$$

where n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max\ 2}$ indicates a maximum refractive index value of the second core layer lamella;

$n_{min\ 2}$ indicates a minimum refractive index value of the second core layer lamella;

λ indicates a wavelength of an electromagnetic wave corresponding to a center frequency of an antenna;

a indicates a perpendicular distance from the far focus of the metamaterial sub-reflector to the metamaterial sub-reflector;

b indicates a perpendicular distance from the near focus of the metamaterial sub-reflector to the metamaterial sub-reflector; and floor indicates rounding down.

Preferably, when the sub-reflector is a metamaterial sub-reflector, and the metamaterial sub-reflector has an electromagnetic wave reflection characteristic similar to that of a rotating ellipsoid, refractive index distribution of any one of the second core layer lamella meets the following formulas:

$$n(r) = n_{min2} + \frac{Gz - Gr - k\lambda}{2d_2};$$

$$d_2 = \frac{\lambda}{2(n_{max2} - n_{min2})};$$

$$k = \text{floor}\left(\frac{Gz - Gr}{\lambda}\right);$$

$$Gz = a + (L - b);$$

$$Gr = \sqrt{r^2 + a^2} + \left(L - \sqrt{r^2 + b^2}\right);$$

where, n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max\ 2}$ indicates a maximum refractive index value of the second core layer lamella;

$n_{min\ 2}$ indicates a minimum refractive index value of the second core layer lamella;

λ indicates a wavelength of an electromagnetic wave corresponding to a center frequency of an antenna;

a indicates a perpendicular distance from the far focus of the metamaterial sub-reflector to the metamaterial sub-reflector;

b indicates a perpendicular distance from the near focus of the metamaterial sub-reflector to the metamaterial sub-reflector;

L indicates a maximum value of a radius of the second core layer lamella; and floor indicates rounding down.

Preferably, the first base material includes a lamellar first front substrate and a first rear substrate, the multiple first conductive geometric structures are disposed between the first front substrate and the first rear substrate, the first core layer lamella is 0.21-2.5 mm in thickness, the first front substrate is 0.1-1 mm in thickness, the first rear substrate is 0.1-1 mm in thickness, and the multiple first conductive geometric structures are 0.01-0.5 mm in thickness.

Preferably, the second base material includes a lamellar second front substrate and a second rear substrate, the multiple second conductive geometric structures are disposed between the second front substrate and the second rear substrate, the second core layer lamella is 0.21-2.5 mm in thickness, the second front substrate is 0.1-1 mm in thickness, the second rear substrate is 0.1-1 mm in thickness, and the multiple second conductive geometric structures are 0.01-0.5 mm in thickness.

Preferably, the first core layer lamella is 0.818 mm in thickness, the first front substrate and the first rear substrate are both 0.4 mm in thickness, and the multiple first conductive geometric structures are 0.018 mm in thickness.

Preferably, the first conductive geometric structure is a metallic geometric structure, and the metallic geometric structure consists of one or multiple metal wires, the metal wires are copper wires, silver wires, or aluminium wires, and the multiple first conductive geometric structures on the first base material are obtained by means of etching, electroplating, drilling, photolithography, electronic engraving, or ion engraving.

Preferably, the first conductive geometric structure and the second conductive geometric structure are both a metallic geometric structure, and the metallic geometric structure consists of one or multiple metal wires, the metal wires are copper wires, silver wires, or aluminium wires, and the multiple first conductive geometric structures on the first base material and the multiple second conductive geometric structures on the second base material are obtained by means of etching, electroplating, drilling, photolithography, electronic engraving, or ion engraving.

Preferably, the multiple first conductive geometric structures of the first base material evolve from a topological diagram of a planar snowflake-like metallic geometric structure, the planar snowflake-like metallic geometric structure has a first metal wire and a second metal wire that bisect each other perpendicularly, the first metal wire and the second metal wire are of equal length, two ends of the first metal wire are connected with two first metal branches of equal length, the two ends of the first metal wire are connected to midpoints of the two first metal branches, two ends of the second metal wire are connected with two second metal branches of equal length, the two ends of the second metal wire are connected to midpoints of the two second metal branches, and the first metal branch and the second metal branch are of equal length.

Preferably, the multiple first conductive geometric structures of the first base material and the multiple second conductive geometric structures of the second base material all evolve from a topological diagram of a planar snowflake-like metallic geometric structure, the planar snowflake-like metallic geometric structure has a first metal wire and a second metal wire that bisect each other perpendicularly, the first metal wire and the second metal wire are of equal length, two ends of the first metal wire are connected with two first metal branches of equal length, the two ends of the first metal wire are connected to midpoints of the two first metal branches, two ends of the second metal wire are connected with two second metal branches of equal length, the two ends of the second metal wire are connected to midpoints of the two second metal branches, and the first metal branch and the second metal branch are of equal length.

Preferably, both ends of each first metal branch and each second metal branch of the planar snowflake-like metallic geometric structure are further connected with two third metal branches that are totally the same, and corresponding midpoints of the third metal branches are respectively connected to endpoints of the first metal branch and the second metal branch.

Preferably, the first metal wire and the second metal wire of the planar snowflake-like metallic geometric structure are both set with two bending parts, and a figure, obtained by rotating the planar snowflake-like metallic geometric structure by 90 degrees around an intersection point of the first metal wire and the second metal wire in a plane where the planar snowflake-like metallic geometric structure is located, coincides with an original figure.

According to the Cassegrain-type metamaterial antenna in the disclosure, a main reflector in a form of a conventional paraboloid is replaced with a lamellar metamaterial main reflector, which allows for easier manufacturing and processing and lower costs. The Cassegrain-type metamaterial antenna can be applied to various areas such as, satellite antenna, microwave antenna, and radar antenna, according to a choice of different frequencies.

BRIEF DESCRIPTION OF DRAWINGS

The accompanying drawings described herein are provided to help further understand the disclosure, and constitute a part of this application, and exemplary embodiments and descriptions of the disclosure are used for explaining the disclosure, but do not constitute a limitation on the disclosure. In the drawings.

DESCRIPTION OF EMBODIMENTS

Figure 1:
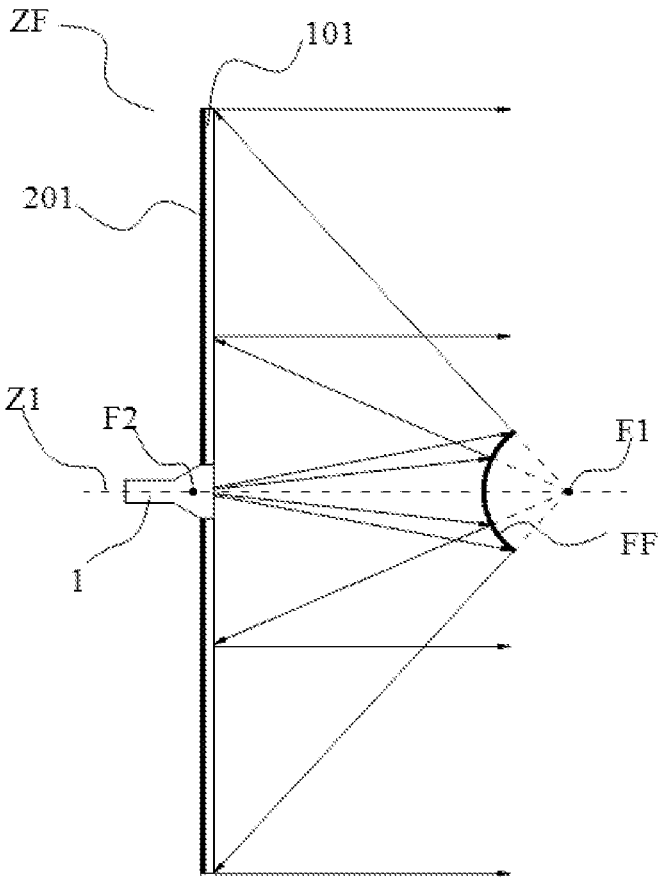
FIG. 1 is a schematic structural diagram 1 of a Cassegrain-type metamaterial antenna according to an embodiment of the disclosure.

The following describes embodiments of the disclosure with reference to the accompanying drawings. It should be noted that the following embodiments of the present application and the features of the embodiments may combine with each other if no contradiction occurs.

Embodiments of the disclosure provide a Cassegrain-type metamaterial antenna, including: a metamaterial main reflector having a central through-hole, a feed source disposed in the central through-hole, and a sub-reflector disposed in front of the feed source, where an electromagnetic wave radiated by the feed source is emerged in a form of a plane wave after being reflected by the sub-reflector and the metamaterial main reflector in sequence; the metamaterial main reflector includes: a first core layer and a first reflection layer disposed on a rear surface of the first core layer, where the first core layer includes at least one first core layer lamella, and the first core layer lamella includes: a first base material and multiple first conductive geometric structures (also called artificial microstructure) disposed on the first base material; and a far focus of the sub-reflector coincides with a phase center of the feed source.

Preferably, the sub-reflector has an electromagnetic wave reflection characteristic of reflecting a direction of an electromagnetic wave radiated by the feed source to a radiation direction of a near focus, that is, a reflection extension line of the direction that is reflected by the sub-reflector and is of the electromagnetic wave radiated by the feed source converges at the near focus. The characteristic may be determined by a structure or a material (and structure of the material) of the sub-reflector, for example, the structure of the sub-reflector is a curved surface shape of a rotating two-sheet hyperboloid, or a curved surface shape of a rotating ellipsoid, or may be endowed, due to a special material of the sub-reflector, with a similar reflection characteristic of a rotating two-sheet hyperboloid or a rotating ellipsoid curved surface.

The following respectively describes solutions using a preferably selected sub-reflector.

Embodiment 1

As shown in FIG. 1 to FIG. 4, according to an embodiment of the disclosure, a Cassegrain-type metamaterial antenna is provided, including: a metamaterial main reflector ZF having a central through-hole TK, a feed source 1 disposed in the central through-hole TK, and a sub-reflector FF disposed in front of the feed source 1, where an electromagnetic wave radiated by the feed source 1 is emerged in a form of a plane wave after being reflected by the sub-reflector FF and the metamaterial main reflector ZF in sequence; the metamaterial main reflector ZF includes: a core layer 101 and a reflection layer 201 disposed on a rear surface of the core layer 101, where the core layer 101 includes at least one core layer lamella 10, and the core layer lamella 10 includes: a base material JC1 and multiple conductive geometric structures JG1 disposed on the base material JC1; and the sub-reflector FF is a curved surface of a rotating two-sheet hyperboloid, and a phase center of the feed source 1 coincides with a far focus F2 of the rotating two-sheet hyperboloid. The phase center of the feed source 1 is namely a point where phases of electromagnetic waves in the feed source are equal, that is, the feed source can be equivalent to an ideal point source, and the location of the ideal point source is point F2 shown in the figure.

In the embodiment of the disclosure, a real axis Z1 of the rotating two-sheet hyperboloid is perpendicular to the metamaterial main reflector ZF. The real axis Z1 of the rotating two-sheet hyperboloid is namely a focal axis, namely, a straight line where a connecting line of a near focus F1 and a far focus F2 of the rotating two-sheet hyperboloid is located. The near focus F1 is close to the sub-reflector FF, and the far focus F2 coincides with the phase center of the feed source 1.

In the embodiment of the disclosure, preferably, the feed source 1 is a corrugated horn, and the real axis of the rotating two-sheet hyperboloid passes through a center of an aperture of the corrugated horn.

In the embodiment of the disclosure, the reflection layer may be a metal reflecting plate with a smooth surface, for example, a polished copper plate, aluminium plate, or iron plate, or may be a PEC (a Perfect Electric Conductor) reflecting surface, or certainly may also be a metal coating, for example, a copper coating. In the embodiment of the disclosure, any longitudinal section of the core layer lamella 10 has the same shape and area, where the longitudinal section refers to a cross section that is in the core layer lamella 10 and is perpendicular to a real axis of the rotating two-sheet hyperboloid. The longitudinal section of the core layer lamella may be a square, or may further be a circle or an ellipsoid, for example, a 300×300 mm or 450×450 mm square, or a circle in a diameter of 250, 300, or 450 mm.

In the embodiment of the disclosure, refractive index distribution of any one of the core layer lamella 10 meets the following formulas:

$$n(R) = n_{max1} - \frac{\sqrt{s^2 + R^2} - (s + k\lambda)}{2d_1}; \quad (1)$$

$$d_1 = \frac{\lambda}{2(n_{max1} - n_{min1})}; \quad (2)$$

$$k = \text{floor}\left(\frac{\sqrt{s^2 + R^2} - s}{\lambda}\right); \quad (3)$$

where, n(R) indicates a refractive index value when a radius of the core layer lamella 10 is R, and a center of a circle of refractive index distribution of the core layer lamella is an intersection point of the real axis of the rotating two-sheet hyperboloid and the core layer lamella;

s indicates a distance from the near focus of the rotating two-sheet hyperboloid to a front surface of the metamaterial main reflector;

$d_1$ indicates a thickness of the core layer;

$n_{max\ 1}$ indicates a maximum refractive index value of the core layer lamella;

$n_{min\ 1}$ indicates a minimum refractive index value of the core layer lamella;

λ indicates a wavelength of an electromagnetic wave corresponding to a center frequency of an antenna; and floor indicates rounding down.

For example, when $$\frac{\sqrt{s^2 + R^2} - s}{\lambda}$$

(R in a certain value range) is greater than or equal to 0 and less than 1, k is 0; when $$\frac{\sqrt{s^2 + R^2} - s}{\lambda}$$

(R in a certain value range) is greater than or equal to 1 and less than 2, k is 1; and so on.

Figure 2:
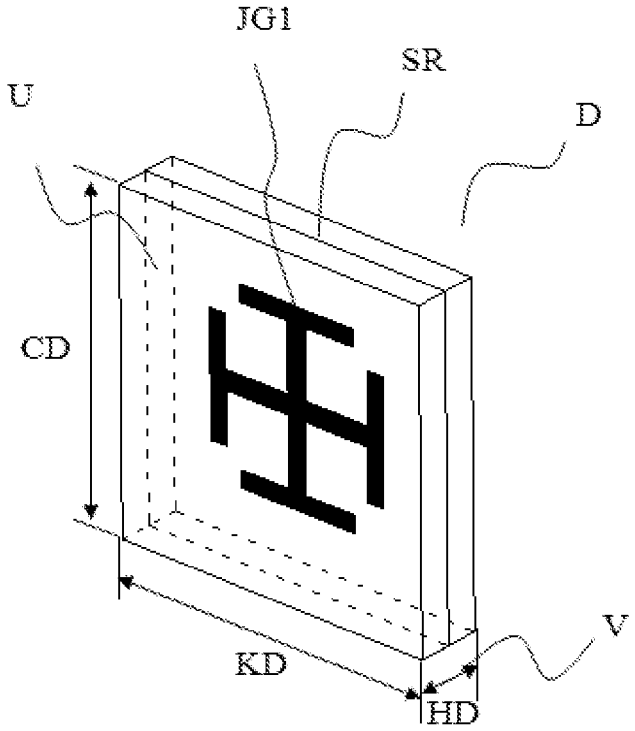
FIG. 2 is a schematic perspective diagram of a metamaterial unit of a first core layer lamella in a manner according to an embodiment of the disclosure.
Figure 4:
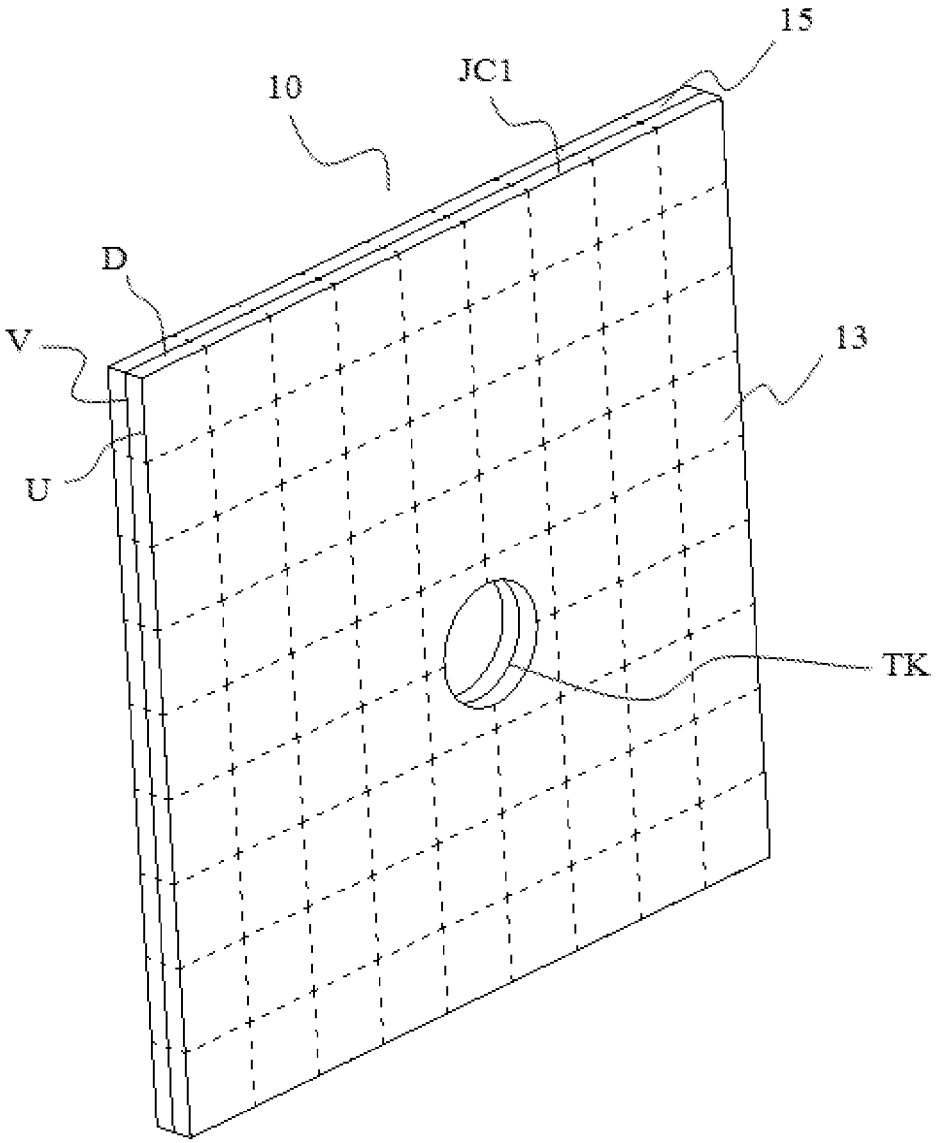
FIG. 4 is a schematic structural diagram of a first core layer lamella in a manner according to an embodiment of the disclosure.

In the embodiment of the disclosure, for ease of understanding, as shown in FIG. 2 and FIG. 4, the core layer lamella 10 can be divided into multiple metamaterial units D that are distributed in a rectangular array manner shown in FIG. 2, each metamaterial unit D includes a front substrate unit U, a rear substrate unit V, and a conductive geometric structure JG1 disposed between the front substrate unit U and the rear substrate unit V, and usually a length, width, and thickness of the metamaterial unit D are all not greater than ⅕ of a wavelength of an electromagnetic wave corresponding to a center frequency of an antenna, preferably 1/10; therefore, dimensions of the metamaterial unit D can be determined according to the center frequency of the antenna. FIG. 2 is a perspective drawing showing a position of the metamaterial unit D in the conductive geometric structure. As shown in FIG. 2, the conductive geometric structure JG1 is disposed between the front substrate unit U and the rear substrate unit V, and a surface of the conductive geometric structure JG1 is represented by SR.

Figure 3:
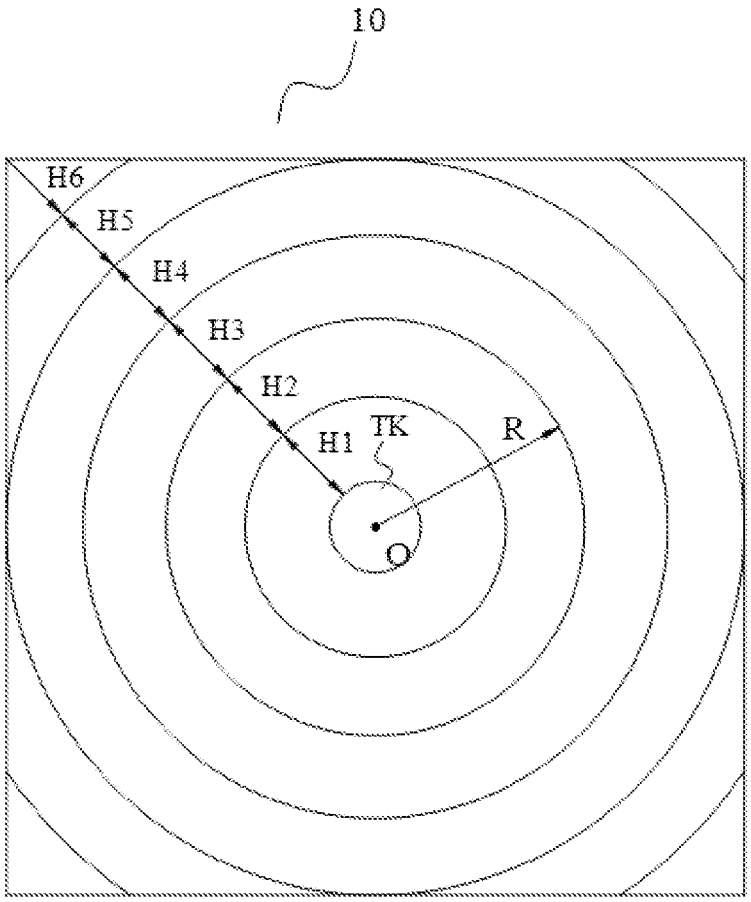
FIG. 3 is a schematic diagram of refractive index distribution of a first core layer lamella in a manner according to an embodiment of the disclosure.

The core layer lamella determined by formula (1) to formula (3) remains an unchanged refractive index along its normal direction and refractive index distribution of the core layer lamella in a plane perpendicular to the normal is shown in FIG. 3, where multiple concentric annular areas are included, a center of the circle is point O in the figure, and preferably, the center of the circle is a midpoint of the plane. FIG. 3 exemplarily shows annular area H1 to annular area H6, where refractive indexes obtained at the same radius in each annular area are equal, a refractive index gradually decreases when the radius increases, and there are two neighboring annular areas where a refractive index has a jump change in their connection position, that is, in two neighboring annular areas, a refractive index at the outermost side in an interior annular area is $n_{min\ 1}$, a refractive index at the innermost side in an exterior annular area is $n_{max\ 1}$, for example, in FIG. 3, a refractive index at the outermost side in the annular area H1 is $n_{min\ 1}$, and a refractive index at the innermost side in the annular area H2 is $n_{max\ 1}$. It should be noted that, an annular area may not be complete, and may be incomplete, for example, in the annual areas H5 and H6 in FIG. 3, only when the longitudinal section of the core layer lamella 10 is a circle, multiple annular areas obtained by the core layer lamella 10 are all complete annual areas.

In the embodiment of the disclosure, the foregoing radius refers to a distance from the center O of the circle in FIG. 3 to a surface of each metamaterial unit, and the foregoing radius is not strictly a continuous change range; however, since each metamaterial unit is far less than a wavelength of an electromagnetic wave corresponding to a center frequency of an antenna, the foregoing radius can be approximately deemed as continuously changed.

The core layer lamella determined by formula (1) to formula (3) has a refractive index distribution rule shown in FIG. 3. According to the center frequency of the antenna, the number of core layer lamellas (namely core layer thickness) is rationally designed, so that an electromagnetic wave radiated from the near focus F1 of the rotating two-sheet hyperboloid can be emerged in a form of a plane wave perpendicular to the core layer lamella after passing through the metamaterial main reflector, that is, a focus of the metamaterial main reflector coincides with the near focus F1 of the rotating two-sheet hyperboloid.

According to common sense and general knowledge, it can be learned that, a reflection extension line of an electromagnetic wave obtained after an electromagnetic wave radiated by the phase center (namely the far focus F2) of the feed source 1 is reflected by a curved surface (the sub-reflector) of a rotating two-sheet hyperboloid must pass through the near focus F1 . In this way, if the near focus F1 is designed as the focus of the metamaterial main reflector, the electromagnetic wave can be emerged in a form of a plane wave after being reflected by the metamaterial main reflector; vice verse, that is, an incident plane electromagnetic wave perpendicular to the metamaterial main reflector converges at the phase center (namely the far focus F2) of the feed source.

In the embodiment of the disclosure, preferably, a shape and area of a curved surface of the sub-reflector are adapt to a shape and area of a curved surface of the main reflector, namely as shown in FIG. 1, so that the electromagnetic wave emerged from an edge of the sub-reflector exactly reaches an edge of the metamaterial main reflector.

In the embodiment of the disclosure, as shown in FIG. 4, the base material JC1 includes a lamellar front substrate 13 and rear substrate 15, the multiple conductive geometric structures are disposed between the front substrate 13 and the rear substrate 15, the core layer lamella is 0.21-2.5 mm in thickness, the front substrate is 0.1-1 mm in thickness, the rear substrate is 0.1-1 mm in thickness, and the multiple conductive geometric structures are 0.01-0.5 mm in thickness.

As an example, the core layer lamella is 0.818 mm in thickness, the front substrate and the rear substrate are both 0.4 mm in thickness, and the multiple conductive geometric structures are 0.018 mm in thickness.

After thickness of each core layer lamella is determined, the number of layers can be determined as required, so as to form a core layer with d thickness.

In the embodiment of the disclosure, the base material may be made from materials such as ceramics, polystyrene, polypropylene, polyimide, polyethylene, polyether ether ketone or polytetrafluoroethylene. For example, a polytetrafluoroethylene plate (PS plate) enjoys optimal electrical insulation performance, generates no interference on an electric field of an electromagnetic wave, and features outstanding chemical stability, corrosion resistance, and an extended service life.

In the embodiment of the disclosure, preferably, the conductive geometric structure JG1 is a metallic geometric structure (also called a metal microstructure), where the metallic geometric structure consists of one or multiple metal wires, the metal wires are copper wires, silver wires, or aluminium wires, and the multiple conductive geometric structures on the base material JC1 are obtained by means of etching, electroplating, drilling, photolithography, electronic engraving, or ion engraving. For example, in terms of the core layer lamella shown in FIG. 4, one of the front substrate 13 or rear substrate 15 is first coated with copper, then unnecessary copper is removed through a technique such as etching so as to obtain planar distribution of the multiple conductive geometric structures, and finally the front substrate and the rear substrate are glued together by using a hot melt adhesive to form a core layer lamella. Multiple core layer lamellas can be formed by using the foregoing method, and a multi-layer core layer is obtained by using a hot melt adhesive to glue each core layer lamella. Materials of the hot melt adhesive may be better consistent with materials of the core layer lamella.

Figure 5:
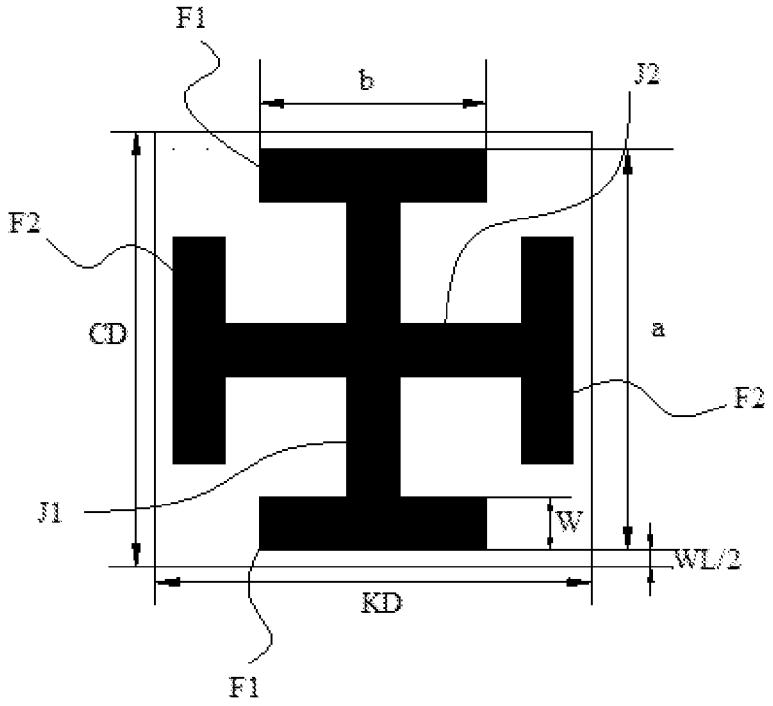
FIG. 5 is a schematic diagram of a topological diagram of a planar snowflake-like metallic geometric structure according to an embodiment of the disclosure.

In the embodiment of the disclosure, preferably, the multiple conductive geometric structures of the base material evolve from a topological diagram of a planar snowflake-like metallic geometric structure shown in FIG. 5. That is, the topological diagram of the planar snowflake-like metallic geometric structure shown in FIG. 5 is a basic planar topological diagram of a planar snowflake-like metallic geometric structure, and topological diagrams of all metallic geometric structures of a same base material all evolve from the diagram shown in FIG. 5.

As shown in FIG. 5, the planar snowflake-like metallic geometric structure has a first metal wire J1 and a second metal wire J2 that bisect each other perpendicularly, the first metal wire J1 and the second metal wire J2 are of equal length, two ends of the first metal wire J1 are connected with two first metal branches F1 of equal length, the two ends of the first metal wire J1 are connected to midpoints of the two first metal branches F1, two ends of the second metal wire J2 are connected with two second metal branches F2 of equal length, the two ends of the second metal wire J2 are connected to midpoints of the two second metal branches F2, and the first metal branch F1 and the second metal branch F2 are of equal length.

Figure 6:
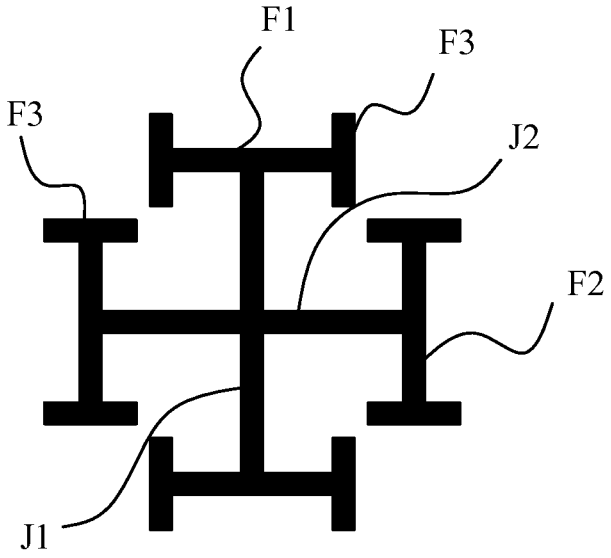
FIG. 6 is a derived structure of the planar snowflake-like metallic geometric structure shown in FIG. 5.

FIG. 6 is a derived structure of the planar snowflake-like metallic geometric structure shown in FIG. 5. Both ends of each first metal branch F1 and each second metal branch F2 of the derived planar snowflake-like metallic geometric structure are both connected with two third metal branches F3 that are totally the same, and corresponding midpoints of the third metal branches F3 are respectively connected to endpoints of the first metal branch F1 and the second metal branch F2. By analogy, other types of metallic geometric structures can be derived from the embodiment of the disclosure. Similarly, the diagram shown in FIG. 6 is only a basic planar topological diagram.

Figure 7:
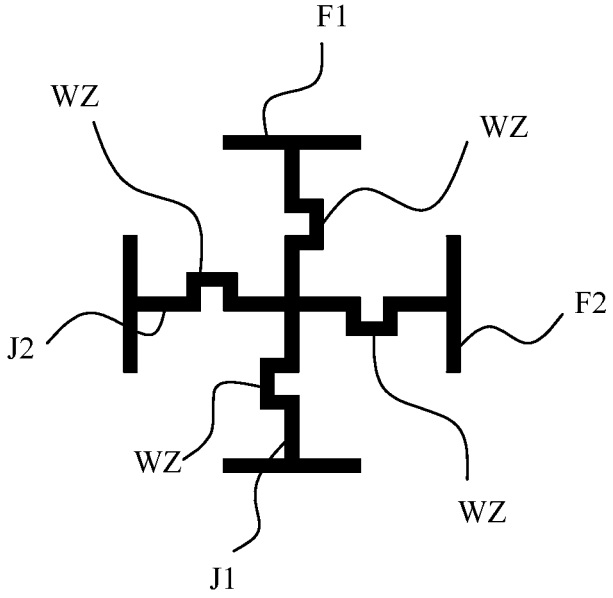
FIG. 7 is a deformed structure of the planar snowflake-like metallic geometric structure shown in FIG. 5.

FIG. 7 shows a deformed structure of the planar snowflake-like metallic structure shown in FIG. 5. In this type of metallic structure, the first metal wire J1 and the second metal wire J2 are not straight lines but meander lines, the first metal wire J1 and the second metal wire J2 are both set with two bending parts WZ, but the metal wire J1 and the second metal wire J2 still bisect each other perpendicularly. By setting directions of the bending parts and relative positions of the bending parts in the first metal wire and the second metal wire, a figure, obtained by rotating the metallic geometric structure shown in FIG. 7 by 90 degrees along any direction perpendicular to an axis of an intersection point of the first metal wire and the second metal wire, coincides with an original figure. In addition, another deformation may also be available, for example, the first metal wire J1 and the second metal wire J2 are separately disposed with multiple bending parts WZ. Similarly, the diagram shown in FIG. 7 is only a basic planar topological diagram.

It is known that, the refractive index is $n=\sqrt{\mu\in}$, where $\mu$ is relative magnetic conductivity, $\in$ is a relative permittivity, and $\mu$ and $\in$ are jointly called an electromagnetic parameter. It is testified that, when an electromagnetic wave passes through a dielectric material with uneven refractive indexes, the electromagnetic wave deviates to a direction of a larger refractive index. In the case of a specific relative magnetic conductivity (usually close to 1), a refractive index is related to a permittivity only. In the case of a determined base material, any value (in a certain range) of a refractive index of a metamaterial unit can be implemented by using a conductive geometric structure that is responsive only to an electromagnetic field. Under a center frequency of the antenna, a condition of change, along with refractive index change of a topological diagram, of a permittivity of a certain-shape conductive geometric structure (the planar snowflake-like metallic geometric structure shown in FIG. 5) can be obtained by using simulation software such as CST, MATLAB, and COMSOL. That is, data of correspondence may be obtained, that is, our required core layer lamella 10 with specific refractive index distribution can be designed.

In the embodiment, planer distribution of conductive geometric structures on a core layer lamella may be obtained by means of computer simulation (for example, CST simulation). Specific steps are as follows:

(1) Determine a base material attached on a conductive geometric structure. For example, a dielectric substrate whose permittivity is 2.7 and whose material can be FR-4, F4b, or PS is determined (2) Determine dimensions of a metamaterial unit. The dimensions of the metamaterial unit are obtained according to a center frequency of the antenna. A wavelength of the metamaterial unit is obtained according to the frequency, a numeric value less than ⅕ of the wavelength is used as length CD and width KD of a metamaterial unit D, and then a numeric value less than 1/10 of the wavelength is used as thickness of the metamaterial unit D. For example, for an 11.95 G antenna center frequency, the metamaterial unit D is a square plate that is shown in FIG. 2, whose length CD and width KD are both 2.8 mm, and whose thickness HD is 0.543 mm.

(3) Determine a material and basic planar topological diagram of the conductive geometric structure. In the embodiment of the disclosure, the conductive geometric structure is a metallic geometric structure, and a material of the metallic geometric structure is copper, a topological diagram of a basic planar topological diagram of the metallic geometric structure is a planar snowflake-like metallic geometric structure shown in FIG. 5, and the metallic geometric structure has an equal line width W in each part. The basic planar topological diagram herein is a basis on which topological diagrams of all conductive geometric structures on a same base material evolve.

(4) Determine parameters of the topological diagram of the conductive geometric structure. As shown in FIG. 5, in the embodiment of the disclosure, the parameters of the topological diagram of the planar snowflake-like metallic geometric structure include line width W of the metallic geometric structure, length a of the first metal wire J1, length b of the first metal branch F1, thickness HD of the metallic geometric structure. In the embodiment of the disclosure, the thickness remains unchanged, and takes a value of 0.018 mm.

(5) Determine an evolution restriction condition of the topological diagram of the metallic geometric structure. In the embodiment of the disclosure, an evolution restriction condition of the topological diagram of the metallic geometric structure includes: a minimum spacing WL between metallic geometric structures (as shown in FIG. 5, a distance between a metallic geometric structure and a long side or a wide side of a metamaterial unit is WL/2), a line width W of a metallic geometric structure, and dimensions of a metamaterial unit. Due to a restriction of a processing technique, WL is greater than or equal to 0.1 mm; and likewise, the line width W also needs to be greater than or equal to 0.1 mm. During first simulation, WL may be 0.1 mm, and W may be 0.3 mm, dimensions of a metamaterial unit are that length and width are 2.8 mm, and that thickness is 0.818 mm (the metallic geometric structure is 0.018 mm in thickness, and the base material is 0.8 mm in thickness). In this case, the parameter of the topological diagram of the metallic geometric structure includes only two variables: a and b. For the topological diagram of the metallic geometric structure, in terms of a specific center frequency (for example, 11.95 GHZ), a continuous refractive index change range may be obtained according to an evolution manner shown in FIG. 8 to FIG. 9.

Figure 8:
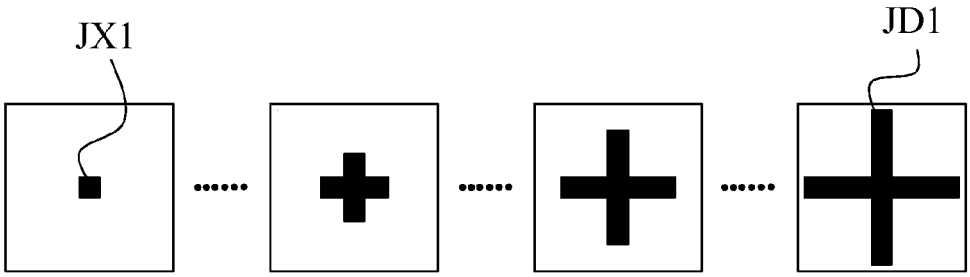
FIG. 8 is a first phase of evolution of a topological diagram of a planar snowflake-like metallic geometric structure according to an embodiment of the disclosure.

Specifically, evolution of a topological diagram of a metallic geometric structure includes two phases (a basic diagram based on which a topological diagram evolves is the metallic geometric structure shown in FIG. 5):

First phase: According to an evolution restriction condition, change value a from a minimum value to a maximum value in the case that value b keeps unchanged. The metallic geometric structure in the evolution process is of a "cross" shape (except when a is the minimum value). In the embodiment of the disclosure, the minimum value of a is 0.3 mm (a line width W), and the maximum value of a is (CD-WL). Therefore, in the first phase, evolution of the topological diagram of the metamaterial unit is shown in FIG. 8, that is, a maximum "cross" topological diagram JD1 is gradually evolved from a square JX1 with a side length of W. In the first phase, along with the evolution of the topological diagram of the metallic geometric structure, a refractive index of a metamaterial unit corresponding to the metallic geometric structure continuously increases (corresponding to a certain antenna frequency).

Figure 9:
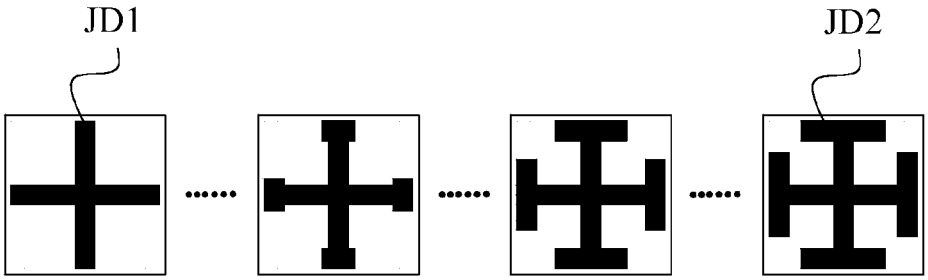
FIG. 9 is a second phase of evolution of a topological diagram of a planar snowflake-like metallic geometric structure according to an embodiment of the disclosure.
Figure 10:
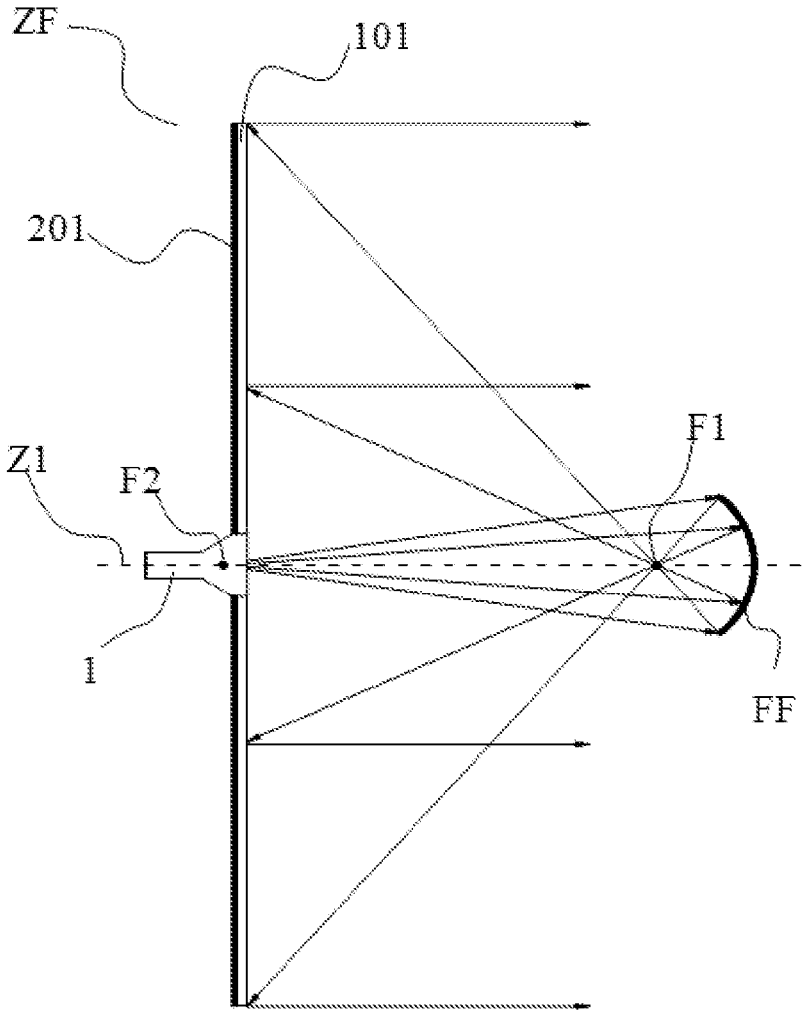
FIG. 10 is a schematic structural diagram 2 of a Cassegrain-type metamaterial antenna according to an embodiment of the disclosure.

Second phase: According to the evolution restriction condition, when a increases to the maximum value, a keeps unchanged. In this case, b is continuously increased to the maximum value from the minimum value. The metallic geometric structure in the evolution process is planar snowflake-like. In the embodiment of the disclosure, the minimum value of b is 0.3 mm (a line width W), and the maximum value of b is (CD-WL-2W). Therefore, in the second phase, evolution of the topological diagram of the metamaterial unit is shown in FIG. 9, that is, a maximum planar snowflake-like topological diagram JD2 is gradually generated from the maximum "cross" topological diagram JD1. The maximum planar snowflake-like topological diagram JD2 herein means that a length b of a first metal branch J1 and a length b of a second metal branch J2 cannot be extended any longer; and otherwise, the first metal branch and the second metal branch are intersected. In the second phase, along with the evolution of the topological diagram of the metallic geometric structure, a refractive index of a metamaterial unit corresponding to the metallic geometric structure continuously increases (corresponding to a certain antenna frequency).

If the refractive index change range of a metamaterial unit obtained though the foregoing evolution includes a continuous change range of $n_{min\ 1}$ to $n_{max\ 1}$, a design demand is met. If the refractive index change range of the metamaterial unit obtained though the foregoing evolution does not meet a design demand, for example, the maximum value is too small or the minimum value is too large, WL and W are modified and simulation is performed again until a refractive index change range required by us is obtained.

According to formulas (1) to (3), after a series of metamaterial units obtained through simulation are distributed according to refractive indexes of the metamaterial units (actually distribution of multiple conductive geometric structures of various topological diagrams on a base material), the core layer lamella of the embodiment of the disclosure can be obtained.

Embodiment 2

As shown in FIG. 10, and FIG. 2 to FIG. 4, according to an embodiment of the disclosure, a Cassegrain-type metamaterial antenna is provided, including: a metamaterial main reflector ZF having a central through-hole TK, a feed source 1 disposed in the central through-hole TK, and a sub-reflector FF disposed in front of the feed source 1, where an electromagnetic wave radiated by the feed source 1 is emerged in a form of a plane wave after being reflected by the sub-reflector FF and the metamaterial main reflector ZF in sequence; the metamaterial main reflector ZF includes: a core layer 101 and a reflection layer 201 disposed on a rear surface of the core layer 101, where the core layer 101 includes at least one core layer lamella 10, and the core layer lamella 10 includes: a base material JC1 and multiple conductive geometric structures JG1 disposed on the base material JC1; and the sub-reflector FF is a curved surface of a rotating ellipsoid, and a phase center of the feed source 1 coincides with a far focus F2 of the rotating ellipsoid. The phase center of the feed source 1 is namely a point where phases of electromagnetic waves in the feed source are equal, that is, an ideal point of feed source equivalence, and the ideal point is point F2 shown in the figure.

In the embodiment of the disclosure, a real axis Z1 of the rotating ellipsoid is perpendicular to the metamaterial main reflector ZF. The real axis Z1 of the rotating ellipsoid is namely a focal axis, namely, a straight line where a connecting line of a near focus F1 and a far focus F2 of the rotating ellipsoid are located. The near focus F1 is close to the sub-reflector FF, and the far focus F2 coincides with the phase center of the feed source 1.

In the embodiment of the disclosure, preferably, the feed source 1 is a corrugated horn, and the real axis of the rotating ellipsoid passes through a center of an aperture of the corrugated horn.

In the embodiment of the disclosure, the reflection layer may be a metal reflecting plate with a smooth surface, for example, a polished copper plate, aluminium plate, or iron plate, or may be a PEC (a Perfect Electric Conductor) reflecting surface, or certainly may also be a metal coating, for example, a copper coating. In the embodiment of the disclosure, any longitudinal section of the core layer lamella 10 has the same shape and area, where the longitudinal section refers to a cross section that is in the core layer lamella 10 and is perpendicular to a real axis of the rotating ellipsoid. The longitudinal section of the core layer lamella may be a square, or may further be a circle or an ellipsoid, for example, a 300×300 mm or 450×450 mm square, or a circle in a diameter of 250, 300, or 450 mm.

In the embodiment of the disclosure, refractive index distribution of any one of the core layer lamella 10 meets the following formulas:

$$n(R) = n_{max1} - \frac{\sqrt{s^2 + R^2} - (s + k\lambda)}{2d_1}; \quad (1)$$

$$d_1 = \frac{\lambda}{2(n_{max1} - n_{min1})}; \quad (2)$$

$$k = \text{floor}\left(\frac{\sqrt{s^2 + R^2} - s}{\lambda}\right); \quad (3)$$

where, n(R) indicates a refractive index value when a radius of the core layer lamella 10 is R, and a center of a circle of refractive index distribution of the core layer lamella is an intersection point of the real axis of the rotating ellipsoid and the core layer lamella;

s indicates a distance from the near focus of the rotating ellipsoid to a front surface of the metamaterial main reflector;

$d_1$ indicates a thickness of the core layer;

$n_{max\ 1}$ indicates a maximum refractive index value of the core layer lamella;

$n_{min\ 1}$ indicates a minimum refractive index value of the core layer lamella;

λ indicates a wavelength of an electromagnetic wave corresponding to a center frequency of an antenna;

floor indicates rounding down.

For example, when $$\frac{\sqrt{s^2 + R^2} - s}{\lambda}$$

(R in a certain value range) is greater than or equal to 0 and less than 1, k is 0; when $$\frac{\sqrt{s^2 + R^2} - s}{\lambda}$$

(R in a certain value range) is greater than or equal to 1 and less than 2, k is 1; and so on.

In the embodiment of the disclosure, for ease of understanding, as shown in FIG. 4, the core layer lamella 10 can be divided into multiple metamaterial units D that are distributed in a rectangular array manner shown in FIG. 2, each metamaterial unit D includes a front substrate unit U, a rear substrate unit V, and a conductive geometric structure JG1 disposed between the front substrate unit U and the rear substrate unit V, and usually a length, width, and thickness of the metamaterial unit D are all not greater than ⅕ of a wavelength of an electromagnetic wave corresponding to a center frequency of an antenna, preferably 1/10; therefore, dimensions of the metamaterial unit D can be determined according to the center frequency of the antenna. FIG. 2 is a perspective drawing showing a position of the metamaterial unit D in the conductive geometric structure. As shown in FIG. 2, the conductive geometric structure JG1 is disposed between the front substrate unit U and the rear substrate unit V, and a surface of the conductive geometric structure JG1 is represented by SR.

The core layer lamella determined by formula (1) to formula (3) remains unchanged refractive index along its normal direction, and refractive index distribution of the core layer lamella in a plane perpendicular to the normal is shown in FIG. 3, where multiple concentric annular areas are included, a center of the circle is point O in the figure, and preferably, the center of the circle is a midpoint of the plane. FIG. 3 exemplarily shows annular area H1 to annular area H6, where refractive indexes obtained at the same radius R in each annular area are equal, a refractive index gradually decreases when the radius R increases, and there are two neighboring annular areas where a refractive index has a jump change in their connection position, that is, in two neighboring annular areas, a refractive index at the outermost side in an interior annular area is $n_{min\ 1}$, a refractive index at the innermost side in an exterior annular area is $n_{max\ 1}$, for example, in FIG. 3, a refractive index at the outermost side in the annular area H1 is $n_{min\ 1}$, and a refractive index at the innermost side in the annular area H2 is $n_{max\ 1}$. It should be noted that, an annular area may not be complete, and may be incomplete, for example, in the annual areas H5 and H6 in FIG. 3, only when the longitudinal section of the core layer lamella 10 is a circle, multiple annular areas obtained by the core layer lamella 10 are all complete annual areas.

In the embodiment of the disclosure, the foregoing radius R refers to a distance from the center O of the circle in FIG. 3 to a surface of each metamaterial unit, and the foregoing radius is not strictly a continuous change range; however, since each metamaterial unit is far less than a wavelength of an electromagnetic wave corresponding to a center frequency of an antenna, the foregoing radius can be approximately deemed as continuously changed.

The core layer lamella determined by formula (1) to formula (3) has a refractive index distribution rule shown in FIG. 3. According to the center frequency of the antenna, the number of core layer lamellas (namely core layer thickness) is rationally designed, so that an electromagnetic wave radiated from the near focus F1 of the rotating ellipsoid can be emerged in a form of a plane wave perpendicular to the core layer lamella after passing through the metamaterial main reflector, that is, a focus of the metamaterial main reflector coincides with the near focus F1 of the rotating ellipsoid.

According to common sense and general knowledge, it can be learned that, a reflection extension line of an electromagnetic wave obtained after an electromagnetic wave radiated by the phase center (namely the far focus F2) of the feed source 1 is reflected by a curved surface (the sub-reflector) of a rotating ellipsoid must pass through the near focus F1. In this way, if the near focus F1 is designed as the focus of the metamaterial main reflector, the electromagnetic wave can be emerged in a form of a plane wave after being reflected by the metamaterial main reflector; vice verse, that is, an incident plane electromagnetic wave perpendicular to the metamaterial main reflector converges at the phase center (namely the far focus F2) of the feed source.

In the embodiment of the disclosure, preferably, a shape and area of a curved surface of the sub-reflector are adapt to a shape and area of a curved surface of the main reflector, namely as shown in FIG. 1, so that the electromagnetic wave emerged from an edge of the sub-reflector exactly reaches an edge of the main reflector.

In the embodiment of the disclosure, as shown in FIG. 4, the base material JC1 includes a lamellar front substrate 13 and rear substrate 15, the multiple conductive geometric structures are disposed between the front substrate 13 and the rear substrate 15, the core layer lamella is 0.21-2.5 mm in thickness, the front substrate is 0.1-1 mm in thickness, the rear substrate is 0.1-1 mm in thickness, and the multiple conductive geometric structures are 0.01-0.5 mm in thickness.

As an example, the core layer lamella is 0.818 mm in thickness, the front substrate and the rear substrate are both 0.4 mm in thickness, and the multiple conductive geometric structures are 0.018 mm in thickness.

After thickness of each core layer lamella is determined, the number of layers can be determined as required, so as to form a core layer with d thickness.

In the embodiment of the disclosure, the base material may be made from materials such as ceramics, polystyrene, polypropylene, polyimide, polyethylene, polyether ether ketone or polytetrafluoroethylene. For example, a polytetrafluoroethylene plate (PS plate) enjoys optimal electrical insulation performance, generates no interference on an electric field of an electromagnetic wave, and features outstanding chemical stability, corrosion resistance, and an extended service life.

In the embodiment of the disclosure, preferably, the conductive geometric structure JG1 is a metallic geometric structure, where the metallic geometric structure consists of one or multiple metal wires, the wires are copper wires, silver wires, or aluminium wires, and the multiple conductive geometric structures on the base material JC1 are obtained by means of etching, electroplating, drilling, photolithography, electronic engraving, or ion engraving. For example, in terms of the core layer lamella shown in FIG. 4, one of the front substrate 13 or rear substrate 15 is first coated with copper, then unnecessary copper is removed through a technique such as etching so as to obtain planar distribution of the multiple conductive geometric structures, and finally the front substrate and the rear substrate are glued together by using a hot melt adhesive to form a core layer lamella. Multiple core layer lamellas can be formed by using the foregoing method, and a multi-layer core layer is obtained by using a hot melt adhesive to glue each core layer lamella. Materials of the hot melt adhesive may be better consistent with materials of the core layer lamella.

In the embodiment of the disclosure, preferably, the multiple conductive geometric structures of the base material evolve from a topological diagram of a planar snowflake-like metallic geometric structure shown in FIG. 5. That is, the topological diagram of the planar snowflake-like metallic geometric structure shown in FIG. 5 is a basic planar topological diagram of a planar snowflake-like metallic geometric structure, and topological diagrams of all metallic geometric structures of a same base material all evolve from the diagram shown in FIG. 5.

As shown in FIG. 5, the planar snowflake-like metallic geometric structure has a first metal wire J1 and a second metal wire J2 that bisect each other perpendicularly, the first metal wire J1 and the second metal wire J2 are of equal length, two ends of the first metal wire J1 are connected with two first metal branches F1 of equal length, the two ends of the first metal wire J1 are connected to midpoints of the two first metal branches F1, two ends of the second metal wire J2 are connected with two second metal branches F2 of equal length, the two ends of the second metal wire J2 are connected to midpoints of the two second metal branches F2, and the first metal branch F1 and the second metal branch F2 are of equal length.

FIG. 6 is a derived structure of the planar snowflake-like metallic geometric structure shown in FIG. 5. Both ends of each first metal branch F1 and each second metal branch F2 of the derived planar snowflake-like metallic geometric structure are both connected with two third metal branches F3 that are totally the same, and corresponding midpoints of the third metal branches F3 are respectively connected to endpoints of the first metal branch F1 and the second metal branch F2. By analogy, other types of metallic geometric structures can be derived from the embodiment of the disclosure. Similarly, the diagram shown in FIG. 6 is only a basic planar topological diagram.

FIG. 7 shows a deformed structure of the planar snowflake-like metallic structure shown in FIG. 5. In this type of metallic structure, the first metal wire J1 and the second metal wire J2 are not straight lines but meander lines, the first metal wire J1 and the second metal wire J2 are both set with two bending parts WZ, but the metal wire J1 and the second metal wire J2 still bisect each other perpendicularly. By setting directions of the bending parts and relative positions of the bending parts in the first metal wire and the second metal wire, a figure, obtained by rotating the metallic geometric structure shown in FIG. 7 by 90 degrees along any direction perpendicular to an axis of an intersection point of the first metal wire and the second metal wire, coincides with an original figure. In addition, another deformation may also be available, for example, the first metal wire J1 and the second metal wire J2 are separately disposed with multiple bending parts WZ. Similarly, the diagram shown in FIG. 7 is only a basic planar topological diagram.

It is known that, the refractive index is $n=\sqrt{\mu\in}$, where μ is relative magnetic conductivity, ∈ is a relative permittivity, and μ and ∈ are jointly called an electromagnetic parameter. It is testified that, when an electromagnetic wave passes through a dielectric material with uneven refractive indexes, the electromagnetic wave deviates to a direction of a larger refractive index. In the case of a specific relative magnetic conductivity (usually close to 1), a refractive index is related to a permittivity only. In the case of a determined base material, any value (in a certain range) of a refractive index of a metamaterial unit can be implemented by using a conductive geometric structure that is responsive only to an electromagnetic field. Under a center frequency of the antenna, a condition of change, along with refractive index change of a topological diagram, of a permittivity of a certain-shape conductive geometric structure (the planar snowflake-like metallic geometric structure shown in FIG. 5) can be obtained by using simulation software such as CST, MATLAB, and COMSOL. That is, data of correspondence may be obtained, that is, our required core layer lamella 10 with specific refractive index distribution can be designed.

In the embodiment, planer distribution of conductive geometric structures on a core layer lamella may be obtained by means of computer simulation (for example, CST simulation). Specific steps are as follows:

(1) Determine a base material attached on a conductive geometric structure. For example, a dielectric substrate whose permittivity is 2.7 and whose material can be FR-4, F4b, or PS is determined (2) Determine dimensions of a metamaterial unit. The dimensions of the metamaterial unit are obtained according to a center frequency of the antenna. A wavelength of the metamaterial unit is obtained according to the frequency, a numeric value less than ⅕ of the wavelength is used as length CD and width KD of a metamaterial unit D, and then a numeric value less than 1/10 of the wavelength is used as thickness of the metamaterial unit D. For example, for an 11.95 G antenna center frequency, the metamaterial unit D is a square plate that is shown in FIG. 2, whose length CD and width KD are both 2.8 mm, and whose thickness HD is 0.543 mm.

(3) Determine a material and basic planar topological diagram of the conductive geometric structure. In the embodiment of the disclosure, the conductive geometric structure is a metallic geometric structure, and a material of the metallic geometric structure is copper, a topological diagram of a basic planar topological diagram of the metallic geometric structure is a planar snowflake-like metallic geometric structure shown in FIG. 5, and the metallic geometric structure has an equal line width W in each part. The basic planar topological diagram herein is a basis on which topological diagrams of all conductive geometric structures on a same base material evolve.

(4) Determine parameters of the topological diagram of the conductive geometric structure. As shown in FIG. 5, in the embodiment of the disclosure, the parameters of the topological diagram of the planar snowflake-like metallic geometric structure include line width W of the metallic geometric structure, length a of the first metal wire J1, length b of the first metal branch F1, thickness HD of the metallic geometric structure. In the embodiment of the disclosure, the thickness remains unchanged, and takes a value of 0.018 mm.

(5) Determine an evolution restriction condition of the topological diagram of the metallic geometric structure. In the embodiment of the disclosure, an evolution restriction condition of the topological diagram of the metallic geometric structure includes: a minimum spacing WL between metallic geometric structures (as shown in FIG. 5, a distance between a metallic geometric structure and a long side or a wide side of a metamaterial unit is WL/2), a line width W of a metallic geometric structure, and dimensions of a metamaterial unit. Due to a restriction of a processing technique, WL is greater than or equal to 0.1 mm; and likewise, the line width W also needs to be greater than or equal to 0.1 mm. During first simulation, WL may be 0.1 mm, and W may be 0.3 mm, dimensions of a metamaterial unit are that length and width are 2.8 mm, and that thickness is 0.818 mm (the metallic geometric structure is 0.018 mm in thickness, and the base material is 0.8 mm in thickness). In this case, the parameter of the topological diagram of the metallic geometric structure includes only two variables: a and b. For the topological diagram of the metallic geometric structure, in terms of a specific center frequency (for example, 11.95 GHZ), a continuous refractive index change range may be obtained according to an evolution manner shown in FIG. 8 to FIG. 9.

Specifically, evolution of a topological diagram of a metallic geometric structure includes two phases (a basic diagram based on which a topological diagram evolves is the metallic geometric structure shown in FIG. 5):

First phase: According to an evolution restriction condition, change value a from a minimum value to a maximum value in the case that value b keeps unchanged. The metallic geometric structure in the evolution process is of a "cross" shape (except when a is the minimum value). In the embodiment of the disclosure, the minimum value of a is 0.3 mm (a line width W), and the maximum value of a is (CD-WL). Therefore, in the first phase, evolution of the topological diagram of the metamaterial unit is shown in FIG. 8, that is, a maximum "cross" topological diagram JD1 is gradually evolved from a square JX1 with a side length of W. In the first phase, along with the evolution of the topological diagram of the metallic geometric structure, a refractive index of a metamaterial unit corresponding to the metallic geometric structure continuously increases (corresponding to a certain antenna frequency).

Second phase: According to the evolution restriction condition, when a increases to the maximum value, a keeps unchanged. In this case, b is continuously increased to the maximum value from the minimum value. The metallic geometric structure in the evolution process is planar snowflake-like. In the embodiment of the disclosure, the minimum value of b is 0.3 mm (a line width W), and the maximum value of b is (CD-WL-2W). Therefore, in the second phase, evolution of the topological diagram of the metamaterial unit is shown in FIG. 9, that is, a maximum planar snowflake-like topological diagram JD2 is gradually generated from the maximum "cross" topological diagram JD1. The maximum planar snowflake-like topological diagram JD2 herein means that a length b of a first metal branch J1 and a length b of a second metal branch J2 cannot be extended any longer; and otherwise, the first metal branch and the second metal branch are intersected. In the second phase, along with the evolution of the topological diagram of the metallic geometric structure, a refractive index of a metamaterial unit corresponding to the metallic geometric structure continuously increases (corresponding to a certain antenna frequency).

If the refractive index change range of a metamaterial unit obtained though the foregoing evolution includes a continuous change range of $n_{min\ 1}$ to $n_{max\ 1}$, a design demand is met. If the refractive index change range of the metamaterial unit obtained though the foregoing evolution does not meet a design demand, for example, the maximum value is too small or the minimum value is too large, WL and W are modified and simulation is performed again until a refractive index change range required by us is obtained.

According to formulas (1) to (3), after a series of metamaterial units obtained through simulation are distributed according to refractive indexes of the metamaterial units (actually distribution of multiple conductive geometric structures of various topological diagrams on a base material), a core layer lamella of the embodiment of the disclosure can be obtained.

Embodiment 3

As shown in FIG. 11 and FIG. 2 to FIG. 4, according to an embodiment of the disclosure, a Cassegrain-type metamaterial antenna is provided, including: a metamaterial main reflector ZF having a central through-hole TK, a feed source 1 disposed in the central through-hole TK, and a sub-reflector FF disposed in front of the feed source 1, where an electromagnetic wave radiated by the feed source 1 is emerged in a form of a plane wave after being reflected by the sub-reflector FF and the metamaterial main reflector ZF in sequence; the metamaterial main reflector ZF includes: a first core layer 101 (equivalent to the foregoing core layer 101) and a first reflection layer 201 (equivalent to the foregoing reflection layer 201) disposed on a rear surface of the first core layer 101, where the first core layer 101 includes at least one first core layer lamella 10, and the first core layer lamella 10 includes: a first base material JC1 (equivalent to the foregoing base material JC1) and multiple first conductive geometric structures JG1 (equivalent to the foregoing conductive geometric structures JG1) disposed on the first base material JC1; and the sub-reflector FF includes a second core layer 102 and a second reflection layer 202 disposed on a rear surface of the second core layer 102, where the second core layer 102 includes at least one second core layer lamella 20, and the second core layer lamella 20 includes a second base material JC2 and multiple second conductive geometric structures JG2 disposed on the second base material JC2, the metamaterial sub-reflector FF has an electromagnetic wave reflection characteristic similar to that of a rotating two-sheet hyperboloid, the metamaterial sub-reflector FF has a near focus F1 and a far focus F2, a phase center of the feed source 1 coincides with the far focus F2 of the metamaterial sub-reflector, and the near focus F1 coincides with a focus of the metamaterial main reflector. The phase center of the feed source 1 is namely a point where phases of electromagnetic waves in the feed source are equal, that is, an ideal point of feed source equivalence, and the ideal point is point F2 shown in the figure. In addition, that the metamaterial sub-reflector FF has an electromagnetic wave reflection characteristic similar to that of a rotating two-sheet hyperboloid refers to that, a reflection extension line of an electromagnetic wave obtained after an electromagnetic wave radiated by the far focus F2 is reflected by the metamaterial sub-reflector FF passes through the near focus F1, and a rotating two-sheet hyperboloid exactly has the characteristic.

In the embodiment of the disclosure, a central axis Z2 of the metamaterial sub-reflector coincides with a central axis Z1 of the metamaterial main reflector. The central axis Z2 of the metamaterial sub-reflector is namely a focal axis, namely, a straight line where a connecting line of the near focus F1 and the far focus F2 of the metamaterial sub-reflector are located. The near focus F1 is close to the metamaterial sub-reflector FF, and the far focus F2 coincides with the phase center of the feed source 1.

In the embodiment of the disclosure, preferably, the feed source 1 is a corrugated horn, and the central axis Z2 of the metamaterial sub-reflector passes through a center of an aperture of the corrugated horn.

In the embodiment of the disclosure, the first reflection layer and the second reflection layer may be a metal reflecting plate with a smooth surface, for example, a polished copper plate, aluminium plate, or iron plate, or may be a PEC (a Perfect Electric Conductor) reflecting surface, or certainly may also be a metal coating, for example, a copper coating. In the embodiment of the disclosure, any longitudinal section of the first core layer lamella 10 has the same shape and area as those of any longitudinal section of the second core layer lamella 20, where the longitudinal section refers to a cross section that is in the first core layer lamella 10 and the second core layer lamella 20 and is perpendicular to the central axis Z2 of the metamaterial sub-reflector. The longitudinal section of the first core layer lamella 10 and the longitudinal section of the second core layer lamella 20 may be a square, or may further be a circle or an ellipsoid, for example, a 300×300 mm or 450×450 mm square, or a circle in a diameter of 250, 300, or 450 mm.

In the embodiment of the disclosure, for ease of understanding, as shown in FIG. 2 and FIG. 4, the first core layer lamella 10 can be divided into multiple metamaterial units D that are distributed in a rectangular array manner shown in FIG. 2, each metamaterial unit D includes a front substrate unit U, a rear substrate unit V, and a conductive geometric structure JG1 disposed between the front substrate unit U and the rear substrate unit V, and usually a length, width, and thickness of the metamaterial unit D are all not greater than ⅕ of a wavelength of an electromagnetic wave corresponding to a center frequency of an antenna, preferably 1/10; therefore, dimensions of the metamaterial unit D can be determined according to the center frequency of the antenna. FIG. 2 is a perspective drawing showing a position of the metamaterial unit D in the conductive geometric structure JG1. As shown in FIG. 2, the first conductive geometric structure JG1 is disposed between the front substrate unit U and the rear substrate unit V, and a surface of the conductive geometric structure JG1 is represented by SR.

Figure 11:
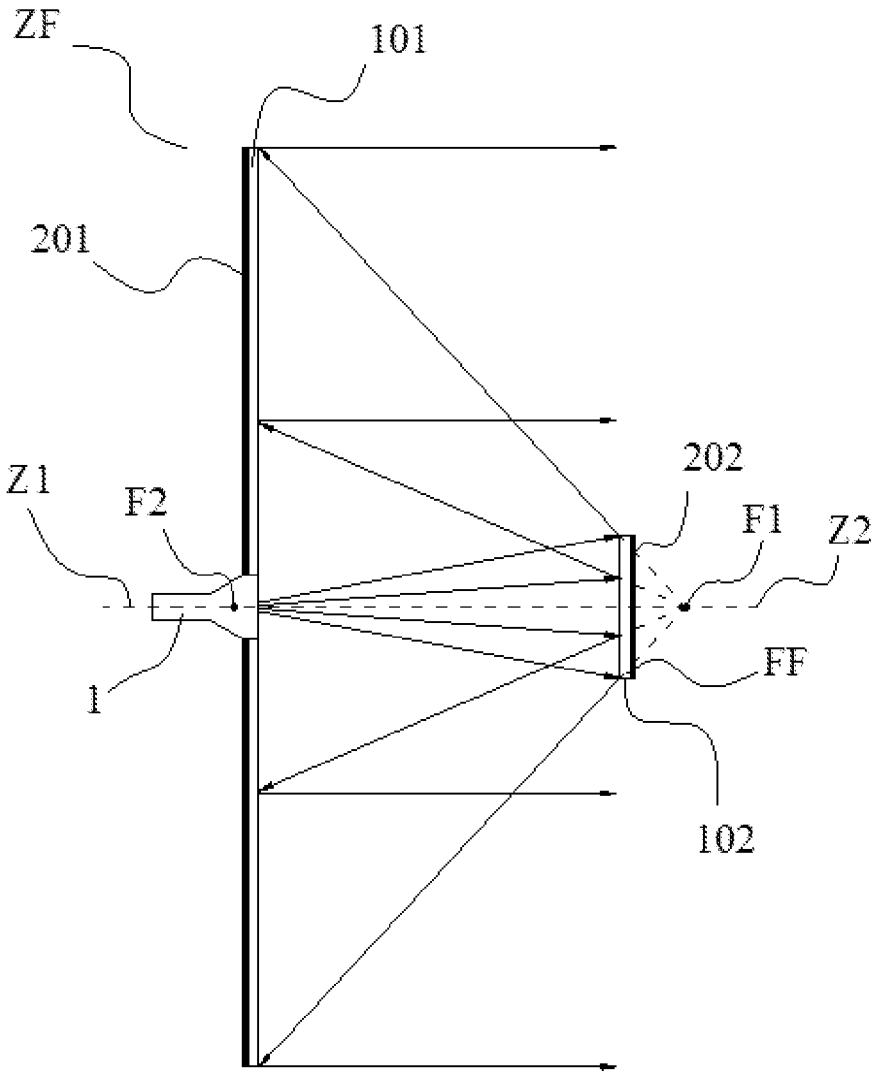
FIG. 11 is a schematic structural diagram 3 of a Cassegrain-type metamaterial antenna according to an embodiment of the disclosure.
Figure 12:
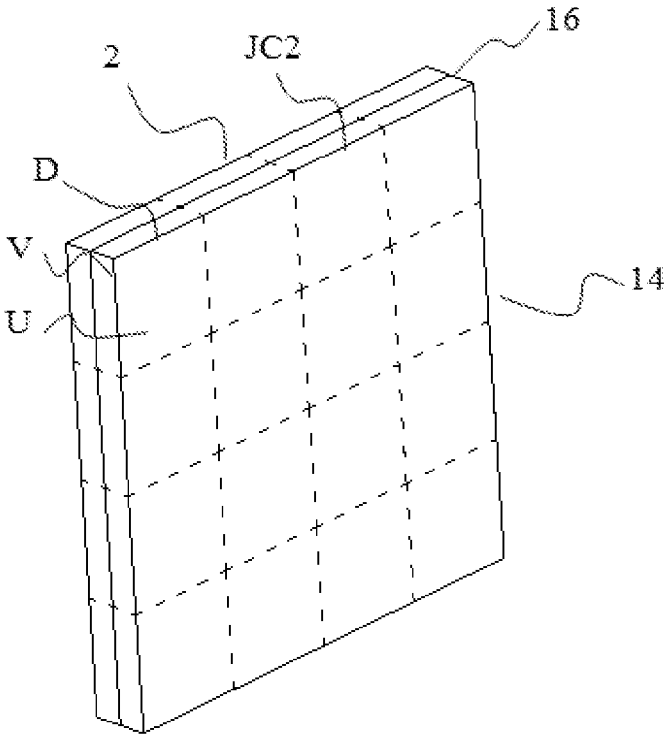
FIG. 12 is a structural diagram of a second core layer lamella in a manner according to an embodiment of the disclosure.
Figure 13:
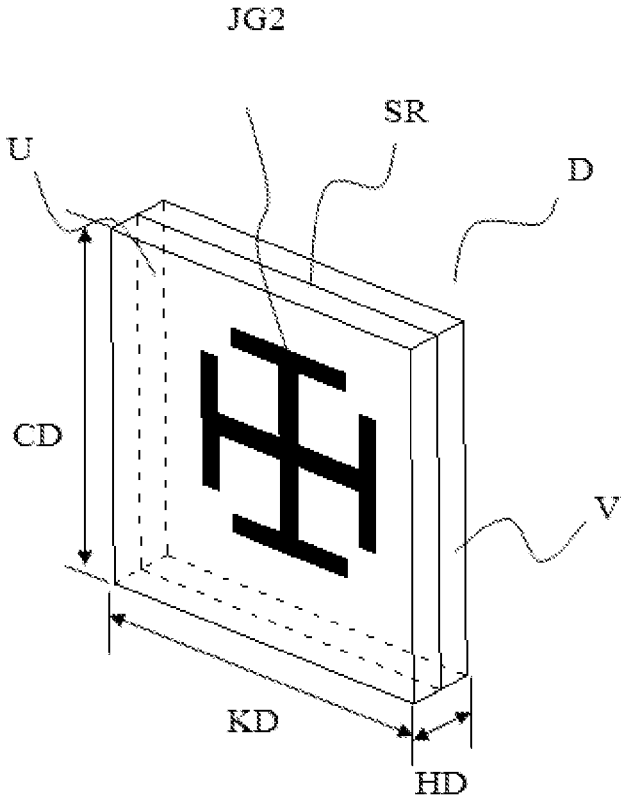
FIG. 13 is a schematic perspective diagram of a metamaterial unit of a second core layer lamella in a manner according to an embodiment of the disclosure.
Figure 14:
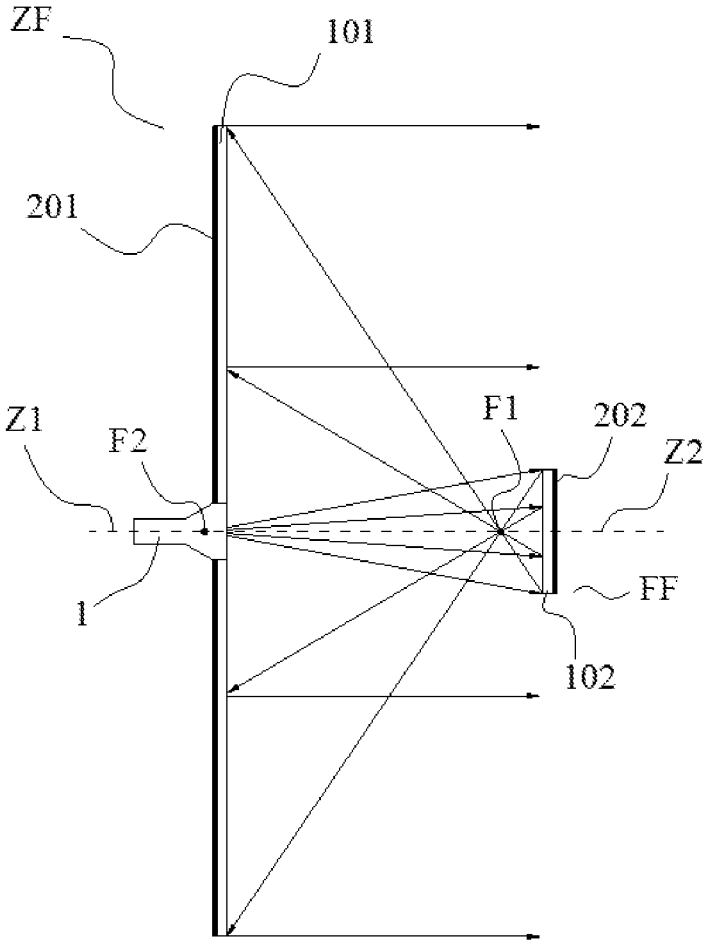
FIG. 14 is a schematic structural diagram 4 of a Cassegrain-type metamaterial antenna according to an embodiment of the disclosure.

Similarly, as shown in FIG. 12 and FIG. 13, the second core layer lamella 20 can be divided into multiple metamaterial units D that are distributed in a rectangular array manner shown in FIG. 11.

In the embodiment of the disclosure, refractive index distribution of any one of the first core layer lamella 10 meets the following formulas:

$$n(R) = n_{max1} - \frac{\sqrt{s^2 + R^2} - (s + k\lambda)}{2d_1}; \tag{1}$$

$$d_1 = \frac{\lambda}{2(n_{max1} - n_{min1})}; \tag{2}$$

-continued $$k = \text{floor}\left(\frac{\sqrt{s^2 + R^2} - s}{\lambda}\right); \quad (3)$$

where, n(R) indicates a refractive index value when a radius of the first core layer lamella is R, and a center of a circle of refractive index distribution of the first core layer lamella is an intersection point of the central axis of the metamaterial sub-reflector and the first core layer lamella;

s indicates a distance from the near focus of the metamaterial sub-reflector to a front surface of the metamaterial main reflector;

$d_1$ indicates a thickness of the first core layer;

$n_{max\ 1}$ indicates a maximum refractive index value of the first core layer lamella;

$n_{min\ 1}$ indicates a minimum refractive index value of the first core layer lamella;

λ indicates a wavelength of an electromagnetic wave corresponding to a center frequency of an antenna;

floor indicates rounding down.

For example, when $$\frac{\sqrt{s^2 + R^2} - s}{\lambda}$$

(R in a certain value range) is greater than or equal to 0 and less than 1, k is 0; when $$\frac{\sqrt{s^2 + R^2} - s}{\lambda}$$

(R in a certain value range) is greater than or equal to 1 and less than 2, k is 1; and so on.

The first core layer lamella determined by formula (1) to formula (3) remains an unchanged refractive index along its normal direction, and refractive index distribution of the first core layer lamella in a plane perpendicular to the normal is shown in FIG. 3, where multiple concentric annular areas are included, a center of the circle is point O in the figure, and preferably, the center of the circle is a midpoint of the plane. FIG. 3 exemplarily shows annular area H1 to annular area H6, where refractive indexes obtained at the same radius in each annular area are equal, a refractive index gradually decreases when the radius increases, and there are two neighboring annular areas where a refractive index has a jump change in their connection position, that is, in two neighboring annular areas, a refractive index at the outermost side in an interior annular area is $n_{min\ 1}$, a refractive index at the innermost side in an exterior annular area is $n_{max\ 1}$, for example, in FIG. 3, a refractive index at the outermost side in the annular area H1 is $n_{min\ 1}$, and a refractive index at the innermost side in the annular area H2 is $n_{max\ 1}$. It should be noted that, an annular area may not be complete, and may be incomplete, for example, in the annual areas H5 and H6 in FIG. 3, only when the longitudinal section of the first core layer lamella is a circle, multiple annular areas obtained by the first core layer lamella are all complete annual areas.

In the embodiment of the disclosure, the foregoing radius refers to a distance from the center O of the circle in FIG. 3 to a surface of each metamaterial unit, and the foregoing radius is not strictly a continuous change range; however, since each metamaterial unit is far less than a wavelength of an electromagnetic wave corresponding to a center frequency of an antenna, the foregoing radius can be approximately deemed as continuously changed.

The first core layer lamella determined by formula (1) to formula (3) has a refractive index distribution rule shown in FIG. 3. According to the center frequency of the antenna, the number of first core layer lamellas (namely thickness of the first core layer) is rationally designed, so that an electromagnetic wave radiated from the near focus F1 of the metamaterial sub-reflector can be emerged in a form of a plane wave perpendicular to the first core layer lamella after passing through the metamaterial main reflector, that is, a focus of the metamaterial main reflector coincides with the near focus F1 of the metamaterial sub-reflector.

In the embodiment of the disclosure, refractive index distribution of any one of the second core layer lamella 20 meets the following formulas:

$$n(r) = n_{min2} + \frac{Gz - Gr - k\lambda}{2d_2}; \quad (4)$$

$$d_2 = \frac{\lambda}{2(n_{max2} - n_{min2})}; \quad (5)$$

$$k = \text{floor}\left(\frac{Gz - Gr}{\lambda}\right); \quad (6)$$

$$Gz = a + (L - b); \quad (7)$$

$$Gr = \sqrt{r^2 + a^2} + \left(L - \sqrt{r^2 + b^2}\right); \quad (8)$$

where, n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max\ 2}$ indicates a maximum refractive index value of the second core layer lamella;

$n_{min\ 2}$ indicates a minimum refractive index value of the second core layer lamella;

λ indicates a wavelength of an electromagnetic wave corresponding to a center frequency of an antenna;

a indicates a perpendicular distance from the far focus F2 of the metamaterial sub-reflector to the metamaterial sub-reflector FF; namely, a perpendicular distance from a phase center of the feed source to metamaterial sub-reflector FF;

b indicates a perpendicular distance from the near focus F1 of the metamaterial sub-reflector to the metamaterial sub-reflector FF;

L indicates a maximum value of a radius of the second core layer lamella; and floor indicates rounding down.

In terms of the second core layer lamella determined according to formula (4) to formula (8), according to the center frequency of the antenna, the number of second core layer lamellas (namely thickness of the second core layer) is rationally designed, so that the metamaterial sub-reflector has an electromagnetic wave reflection characteristic similar to that of a rotating two-sheet hyperboloid, that is, a reflection extension line of an electromagnetic wave obtained after an electromagnetic wave radiated by the far focus F2 (namely the phase center) is reflected by the metamaterial sub-reflector FF passes through the near focus F1.

In summary, if the near focus F1 is designed as the focus of the metamaterial main reflector, the electromagnetic wave can be emerged in a form of a plane wave after being reflected by the metamaterial sub-reflector for a first time and the metamaterial main reflector for a second time; vice verse, that is, an incident plane electromagnetic wave perpendicular to the metamaterial main reflector converges at the phase center (namely the far focus F2) of the feed source after being reflected by the metamaterial sub-reflector for a first time and the metamaterial main reflector for a second time.

In the embodiment of the disclosure, preferably, a shape and area of the metamaterial sub-reflector are adapt to a shape and area of the main reflector, namely as shown in FIG. 1, so that the electromagnetic wave emerged from an edge of the metamaterial sub-reflector exactly reaches an edge of the metamaterial main reflector.

In the embodiment of the disclosure, as shown in FIG. 3 and FIG. 4, the first base material JC1 includes a lamellar first front substrate 13 and a first rear substrate 15, the multiple first conductive geometric structures JG1 are disposed between the first front substrate 13 and the first rear substrate 15, the first core layer lamella is 0.21-2.5 mm in thickness, the first front substrate is 0.1-1 mm in thickness, the first rear substrate is 0.1-1 mm in thickness, and the multiple first conductive geometric structures are 0.01-0.5 mm in thickness.

As an example, the first core layer lamella is 0.818 mm in thickness, the first front substrate and the first rear substrate are both 0.4 mm in thickness, and the multiple first conductive geometric structures are 0.018 mm in thickness.

In the embodiment of the disclosure, as shown in FIG. 12 and FIG. 13, the second base material JC2 includes a lamellar second front substrate 14 and a second rear substrate 16, the multiple second conductive geometric structures JG2 are disposed between the second front substrate 14 and the second rear substrate 16, the second core layer lamella is 0.21-2.5 mm in thickness, the second front substrate is 0.1-1 mm in thickness, the second rear substrate is 0.1-1 mm in thickness, and the multiple second conductive geometric structures are 0.01-0.5 mm in thickness.

As an example, the second core layer lamella is 0.818 mm in thickness, the second front substrate and the second rear substrate are both 0.4 mm in thickness, and the second multiple conductive geometric structures are 0.018 mm in thickness.

After thickness of the first core layer lamella and thickness of the second core layer lamella are determined, the number of layers can be determined as required, so as to form a first core layer with $d_1$ thickness and a second core layer with $d_2$ thickness.

In the embodiment of the disclosure, the first base material and the second base material may be made from materials such as ceramics, polystyrene, polypropylene, polyimide, polyethylene, polyether ether ketone or polytetrafluoroethylene. For example, a polytetrafluoroethylene plate (PS plate) enjoys optimal electrical insulation performance, generates no interference on an electric field of an electromagnetic wave, and features outstanding chemical stability, corrosion resistance, and an extended service life.

In the embodiment of the disclosure, preferably, the first conductive geometric structure and the second conductive geometric structure are both a metallic geometric structure, where the metallic geometric structure consists of one or multiple metal wires, the wires are copper wires, silver wires, or aluminium wires, and the multiple first conductive geometric structures on the first base material are obtained by means of etching, electroplating, drilling, photolithography, electronic engraving, or ion engraving. For example, in terms of the first core layer lamella 10 shown in FIG. 4, one of the first front substrate 13 or first rear substrate 15 is first coated with copper, then unnecessary copper is removed through a technique such as etching so as to obtain planar distribution of the multiple first conductive geometric structures JG1, and finally the first front substrate 13 and the first rear substrate 15 are glued together by using a hot melt adhesive to form the core layer lamella 10. Multiple first core layer lamellas 10 can be formed by using the foregoing method, and a first core layer 101 of a multi-layer structure is obtained by using a hot melt adhesive to glue each first core layer lamella 10. Materials of the hot melt adhesive may be better consistent with materials of the first core layer lamella.

The second core layer lamella and the second core layer can be obtained by using the foregoing method.

In the embodiment of the disclosure, preferably, the multiple first conductive geometric structures of the first base material and the multiple second conductive geometric structures of the second base material all evolve from a topological diagram of a planar snowflake-like metallic geometric structure shown in FIG. 5. That is, the topological diagram of the planar snowflake-like metallic geometric structure shown in FIG. 5 is a basic planar topological diagram of a planar snowflake-like metallic geometric structure, and topological diagrams of all metallic geometric structures of a same first base material and second base material all evolve from the diagram shown in FIG. 5.

As shown in FIG. 5, the planar snowflake-like metallic geometric structure has a first metal wire J1 and a second metal wire J2 that bisect each other perpendicularly, the first metal wire J1 and the second metal wire J2 are of equal length, two ends of the first metal wire J1 are connected with two first metal branches F1 of equal length, the two ends of the first metal wire J1 are connected to midpoints of the two first metal branches F1, two ends of the second metal wire J2 are connected with two second metal branches F2 of equal length, the two ends of the second metal wire J2 are connected to midpoints of the two second metal branches F2, and the first metal branch F1 and the second metal branch F2 are of equal length.

FIG. 6 is a derived structure of the planar snowflake-like metallic geometric structure shown in FIG. 5. Both ends of each first metal branch F1 and each second metal branch F2 of the derived planar snowflake-like metallic geometric structure are both connected with two third metal branches F3 that are totally the same, and corresponding midpoints of the third metal branches F3 are respectively connected to endpoints of the first metal branch F1 and the second metal branch F2. By analogy, other types of metallic geometric structures can be derived from the embodiment of the disclosure. Similarly, the diagram shown in FIG. 6 is only a basic planar topological diagram.

FIG. 7 shows a deformed structure of the planar snowflake-like metallic structure shown in FIG. 5. In this type of metallic structure, the first metal wire J1 and the second metal wire J2 are not straight lines but meander lines, the first metal wire J1 and the second metal wire J2 are both set with two bending parts WZ, but the metal wire J1 and the second metal wire J2 still bisect each other perpendicularly. By setting directions of the bending parts and relative positions of the bending parts in the first metal wire and the second metal wire, a figure, obtained by rotating the metallic geometric structure shown in FIG. 7 by 90 degrees along any direction perpendicular to an axis of an intersection point of the first metal wire and the second metal wire, coincides with an original figure. In addition, another deformation may also be available, for example, the first metal wire J1 and the second metal wire J2 are separately disposed with multiple bending parts WZ. Similarly, the diagram shown in FIG. 7 is only a basic planar topological diagram.

It is known that, the refractive index is $n=\sqrt{\mu\in}$, where $\mu$ is relative magnetic conductivity, $\in$ is a relative permittivity, and $\mu$ and $\in$ are jointly called an electromagnetic parameter. It is testified that, when an electromagnetic wave passes through a dielectric material with uneven refractive indexes, the electromagnetic wave deviates to a direction of a larger refractive index. In the case of a specific relative magnetic conductivity (usually close to 1), a refractive index is related to a permittivity only. In the case of a determined first base material, any value (in a certain range) of a refractive index of a metamaterial unit can be implemented by using a first conductive geometric structure that is responsive only to an electromagnetic field. Under a center frequency of the antenna, a condition of change, along with refractive index change of a topological diagram, of a permittivity of a certain-shape conductive geometric structure (the planar snowflake-like metallic geometric structure shown in FIG. 5) can be obtained by using simulation software such as CST, MATLAB, and COMSOL. That is, data of correspondence may be obtained, that is, our required first core layer lamella with specific refractive index distribution can be designed. Similarly, our required second core layer lamella with specific refractive index distribution can be designed.

In the embodiment, planer distribution of first conductive geometric structures on a first core layer lamella may be obtained by means of computer simulation (for example, CST simulation). Specific steps are as follows:

(1) Determine a first base material attached on a first conductive geometric structure. For example, a dielectric substrate whose permittivity is 2.7 and whose material can be FR-4, F4b, or PS is determined (2) Determine dimensions of a metamaterial unit. The dimensions of the metamaterial unit are obtained according to a center frequency of the antenna. A wavelength of the metamaterial unit is obtained according to the frequency, a numeric value less than ⅕ of the wavelength is used as length CD and width KD of a metamaterial unit D, and then a numeric value less than 1/10 of the wavelength is used as thickness of the metamaterial unit D. For example, for an 11.95 G antenna center frequency, the metamaterial unit D is a square plate that is shown in FIG. 2, whose length CD and width KD are both 2.8 mm, and whose thickness HD is 0.543 mm.

(3) Determine a material and basic planar topological diagram of the first conductive geometric structure. In the embodiment of the disclosure, the first conductive geometric structure is a metallic geometric structure, and a material of the metallic geometric structure is copper, a topological diagram of a basic planar topological diagram of the metallic geometric structure is a planar snowflake-like metallic geometric structure shown in FIG. 5, and the metallic geometric structure has an equal line width W in each part. The basic planar topological diagram herein is a basis on which topological diagrams of all conductive geometric structures on a same first base material evolve.

(4) Determine parameters of the topological diagram of the first conductive geometric structure. As shown in FIG. 5, in the embodiment of the disclosure, the parameters of the topological diagram of the planar snowflake-like metallic geometric structure include line width W of the metallic geometric structure, length a of the first metal wire J1, length b of the first metal branch F1, thickness HD of the metallic geometric structure. In the embodiment of the disclosure, the thickness remains unchanged, and takes a value of 0.018 mm.

(5) Determine an evolution restriction condition of the topological diagram of the metallic geometric structure. In the embodiment of the disclosure, an evolution restriction condition of the topological diagram of the metallic geometric structure includes: a minimum spacing WL between metallic geometric structures (as shown in FIG. 5, a distance between a metallic geometric structure and a long side or a wide side of a metamaterial unit is WL/2), a line width W of a metallic geometric structure, and dimensions of a metamaterial unit. Due to a restriction of a processing technique, WL is greater than or equal to 0.1 mm; and likewise, the line width W also needs to be greater than or equal to 0.1 mm. During first simulation, WL may be 0.1 mm, and W may be 0.3 mm, dimensions of a metamaterial unit are that length and width are 2.8 mm, and that thickness is 0.818 mm (the metallic geometric structure is 0.018 mm in thickness, and the first base material is 0.8 mm in thickness). In this case, the parameter of the topological diagram of the metallic geometric structure includes only two variables: a and b. For the topological diagram of the metallic geometric structure, in terms of a specific center frequency (for example, 11.95 GHZ), a continuous refractive index change range may be obtained according to an evolution manner shown in FIG. 8 to FIG. 9.

Specifically, evolution of a topological diagram of a metallic geometric structure includes two phases (a basic diagram based on which a topological diagram evolves is the metallic geometric structure shown in FIG. 5):

First phase: According to an evolution restriction condition, change value a from a minimum value to a maximum value in the case that value b keeps unchanged. The metallic geometric structure in the evolution process is of a "cross" shape (except when a is the minimum value). In the embodiment of the disclosure, the minimum value of a is 0.3 mm (a line width W), and the maximum value of a is (CD-WL). Therefore, in the first phase, evolution of the topological diagram of the metamaterial unit is shown in FIG. 8, that is, a maximum "cross" topological diagram JD1 is gradually evolved from a square JX1 with a side length of W. In the first phase, along with the evolution of the topological diagram of the metallic geometric structure, a refractive index of a metamaterial unit corresponding to the metallic geometric structure continuously increases (corresponding to a certain antenna frequency).

Second phase: According to the evolution restriction condition, when a increases to the maximum value, a keeps unchanged. In this case, b is continuously increased to the maximum value from the minimum value. The metallic geometric structure in the evolution process is planar snowflake-like. In the embodiment of the disclosure, the minimum value of b is 0.3 mm (a line width W), and the maximum value of b is (CD-WL-2W). Therefore, in the second phase, evolution of the topological diagram of the metamaterial unit is shown in FIG. 9, that is, a maximum planar snowflake-like topological diagram JD2 is gradually generated from the maximum "cross" topological diagram JD1. The maximum planar snowflake-like topological diagram JD2 herein means that a length b of a first metal branch J1 and a length b of a second metal branch J2 cannot be extended any longer; and otherwise, the first metal branch and the second metal branch are intersected. In the second phase, along with the evolution of the topological diagram of the metallic geometric structure, a refractive index of a metamaterial unit corresponding to the metallic geometric structure continuously increases (corresponding to a certain antenna frequency).

If the refractive index change range of a metamaterial unit obtained though the foregoing evolution includes a continuous change range of $n_{min\ 1}$ to $n_{max\ 1}$ and a continuous change range of $n_{min\ 2}$ to $n_{max\ 2}$, a design demand is met. If the refractive index change range of the metamaterial unit obtained though the foregoing evolution does not meet a design demand, for example, the maximum value is too small or the minimum value is too large, WL and W are modified and simulation is performed again until a refractive index change range required by us is obtained.

According to formulas (1) to (3), after a series of metamaterial units obtained through simulation are distributed according to refractive indexes of the metamaterial units (actually distribution of multiple first conductive geometric structures of various topological diagrams on a first base material), the first core layer lamella of the embodiment of the disclosure can be obtained.

Similarly, according to formulas (4) to (8), after a series of metamaterial units obtained through simulation are distributed according to refractive indexes of the metamaterial units (actually distribution of multiple second conductive geometric structures of various topological diagrams on a second base material), a second core layer lamella of the embodiment of the disclosure can be obtained.

Embodiment 4

As shown in FIG. 14 and FIG. 2 to FIG. 4, according to an embodiment of the disclosure, a Cassegrain-type metamaterial antenna is provided, including: a metamaterial main reflector ZF having a central through-hole TK, a feed source 1 disposed in the central through-hole TK, and a sub-reflector FF disposed in front of the feed source 1, where an electromagnetic wave radiated by the feed source 1 is emerged in a form of a plane wave after being reflected by the sub-reflector FF and the metamaterial main reflector ZF in sequence; the metamaterial main reflector ZF includes: a first core layer 101 (equivalent to the foregoing core layer 101) and a first reflection layer 201 (equivalent to the foregoing reflection layer 201) disposed on a rear surface of the first core layer 101, where the first core layer 101 includes at least one first core layer lamella 10, and the first core layer lamella 10 includes: a first base material JC1 (equivalent to the foregoing base material JC1) and multiple first conductive geometric structures JG1 (equivalent to the foregoing conductive geometric structures JG1) disposed on the first base material JC1; and the sub-reflector FF includes a second core layer 102 and a second reflection layer 202 disposed on a rear surface of the second core layer 102, where the second core layer 102 includes at least one second core layer lamella 20, and the second core layer lamella 20 includes a second base material JC2 and multiple second conductive geometric structures JG2 disposed on the second base material JC2, the metamaterial sub-reflector FF has an electromagnetic wave reflection characteristic similar to that of a rotating ellipsoid, the metamaterial sub-reflector FF has a near focus F1 and a far focus F2, a phase center of the feed source 1 coincides with the far focus F2 of the metamaterial sub-reflector, and the near focus F1 coincides with a focus of the metamaterial main reflector. The phase center of the feed source 1 is namely a point where phases of electromagnetic waves in the feed source are equal, that is, an ideal point of feed source equivalence, and the ideal point is point F2 shown in the figure. In addition, that the metamaterial sub-reflector FF has an electromagnetic wave reflection characteristic similar to that of a rotating ellipsoid refers to that, an electromagnetic wave obtained after an electromagnetic wave radiated by the far focus F2 is reflected by the metamaterial sub-reflector FF converges at the near focus F1, and a rotating ellipsoid exactly has the characteristic.

In the embodiment of the disclosure, a central axis Z2 of the metamaterial sub-reflector coincides with a central axis Z1 of the metamaterial main reflector. The central axis Z2 of the metamaterial sub-reflector is namely a focal axis, namely, a straight line where a connecting line of the near focus F1 and the far focus F2 of the metamaterial sub-reflector are located. The near focus F1 is close to the metamaterial sub-reflector FF, and the far focus F2 coincides with the phase center of the feed source 1.

In the embodiment of the disclosure, preferably, the feed source 1 is a corrugated horn, and the central axis Z2 of the metamaterial sub-reflector passes through a center of an aperture of the corrugated horn.

In the embodiment of the disclosure, the first reflection layer and the second reflection layer may be a metal reflecting plate with a smooth surface, for example, a polished copper plate, aluminium plate, or iron plate, or may be a PEC (a Perfect Electric Conductor) reflecting surface, or certainly may also be a metal coating, for example, a copper coating. In the embodiment of the disclosure, any longitudinal section of the first core layer lamella 10 has the same shape and area as those of any longitudinal section of the second core layer lamella 20, where the longitudinal section refers to a cross section that is in the first core layer lamella 10 and the second core layer lamella 20 and is perpendicular to the central axis Z2 of the metamaterial sub-reflector. The longitudinal section of the first core layer lamella 10 and the longitudinal section of the second core layer lamella 20 may be a square, or may further be a circle or an ellipsoid, for example, a 300×300 mm or 450×450 mm square, or a circle in a diameter of 250, 300, or 450 mm.

In the embodiment of the disclosure, for ease of understanding, as shown in FIG. 2 and FIG. 4, the first core layer lamella 10 can be divided into multiple metamaterial units D that are distributed in a rectangular array manner shown in FIG. 2, each metamaterial unit D includes a front substrate unit U, a rear substrate unit V, and a conductive geometric structure JG1 disposed between the front substrate unit U and the rear substrate unit V, and usually a length, width, and thickness of the metamaterial unit D are all not greater than ⅕ of a wavelength of an electromagnetic wave corresponding to a center frequency of an antenna, preferably 1/10; therefore, dimensions of the metamaterial unit D can be determined according to the center frequency of the antenna. FIG. 2 is a perspective drawing showing a position of the metamaterial unit D in the conductive geometric structure JG1. As shown in FIG. 2, the first conductive geometric structure JG1 is disposed between the front substrate unit U and the rear substrate unit V, and a surface of the conductive geometric structure JG1 is represented by SR.

Similarly, as shown in FIG. 12 and FIG. 13, the second core layer lamella 20 can be divided into multiple metamaterial units D that are distributed in a rectangular array manner shown in FIG. 11.

In the embodiment of the disclosure, refractive index distribution of any one of the first core layer lamella 10 meets the following formulas:

$$n(R) = n_{max1} - \frac{\sqrt{s^2 + R^2} - (s + k\lambda)}{2d_1}; \quad (1)$$

-continued $$d_1 = \frac{\lambda}{2(n_{max1} - n_{min1})}; \quad (2)$$

$$k = \text{floor}\left(\frac{\sqrt{s^2 + R^2} - s}{\lambda}\right); \quad (3)$$

where, n(R) indicates a refractive index value when a radius of the first core layer lamella is R, and a center of a circle of refractive index distribution of the first core layer lamella is an intersection point of the central axis of the metamaterial sub-reflector and the first core layer lamella;

s indicates a distance from the near focus of the metamaterial sub-reflector to a front surface of the metamaterial main reflector;

$d_1$ indicates a thickness of the first core layer;

$n_{max\ 1}$ indicates a maximum refractive index value of the first core layer lamella;

$n_{min\ 1}$ indicates a minimum refractive index value of the first core layer lamella;

λ indicates a wavelength of an electromagnetic wave corresponding to a center frequency of an antenna;

floor indicates rounding down.

For example, when $$\frac{\sqrt{s^2 + R^2} - s}{\lambda}$$

(R in a certain value range) is greater than or equal to 0 and less than 1, k is 0; when $$\frac{\sqrt{s^2 + R^2} - s}{\lambda}$$

(R in a certain value range) is greater than or equal to 1 and less than 2, k is 1; and so on.

The first core layer lamella determined by formula (1) to formula (3) remains an unchanged refractive index along its normal direction, and refractive index distribution of the first core layer lamella in a plane perpendicular to the normal is shown in FIG. 3, where multiple concentric annular areas are included, a center of the circle is point O in the figure, and preferably, the center of the circle is a midpoint of the plane. FIG. 3 exemplarily shows annular area H1 to annular area H6, where refractive indexes obtained at the same radius in each annular area are equal, a refractive index gradually decreases when the radius increases, and there are two neighboring annular areas where a refractive index has a jump change in their connection position, that is, in two neighboring annular areas, a refractive index at the outermost side in an interior annular area is $n_{min\ 1}$, a refractive index at the innermost side in an exterior annular area is $n_{max\ 1}$, for example, in FIG. 3, a refractive index at the outermost side in the annular area H1 is $n_{min\ 1}$, and a refractive index at the innermost side in the annular area H2 is $n_{max\ 1}$. It should be noted that, an annular area may not be complete, and may be incomplete, for example, in the annual areas H5 and H6 in FIG. 3, only when the longitudinal section of the first core layer lamella is a circle, multiple annular areas obtained by the first core layer lamella are all complete annual areas.

In the embodiment of the disclosure, the foregoing radius refers to a distance from the center O of the circle in FIG. 3 to a surface of each metamaterial unit, and the foregoing radius is not strictly a continuous change range; however, since each metamaterial unit is far less than a wavelength of an electromagnetic wave corresponding to a center frequency of an antenna, the foregoing radius can be approximately deemed as continuously changed.

The first core layer lamella determined by formula (1) to formula (3) has a refractive index distribution rule shown in FIG. 3. According to the center frequency of the antenna, the number of first core layer lamellas (namely thickness of the first core layer) is rationally designed, so that an electromagnetic wave radiated from the near focus F1 of the metamaterial sub-reflector can be emerged in a form of a plane wave perpendicular to the first core layer lamella after passing through the metamaterial main reflector, that is, a focus of the metamaterial main reflector coincides with the near focus F1 of the metamaterial sub-reflector.

In the embodiment of the disclosure, refractive index distribution of any one of the second core layer lamella meets the following formulas:

$$n(r) = n_{max2} - \frac{\sqrt{r^2 + a^2} + \sqrt{r^2 + b^2} - (a + b + k\lambda)}{2d_2}; \quad (4)$$

$$d_2 = \frac{\lambda}{2(n_{max2} - n_{min2})}; \quad (5)$$

$$k = \text{floor}\left(\frac{\sqrt{r^2 + a^2} + \sqrt{r^2 + b^2} - (a + b)}{\lambda}\right); \quad (6)$$

where n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max\ 2}$ indicates a maximum refractive index value of the second core layer lamella;

$n_{min\ 2}$ indicates a minimum refractive index value of the second core layer lamella;

λ indicates a wavelength of an electromagnetic wave corresponding to a center frequency of an antenna;

a indicates a perpendicular distance from the far focus of the metamaterial sub-reflector to the metamaterial sub-reflector; namely, a perpendicular distance from a phase center of the feed source to metamaterial sub-reflector FF;

b indicates a perpendicular distance from the near focus of the metamaterial sub-reflector to the metamaterial sub-reflector; and floor indicates rounding down.

In terms of the second core layer lamella determined according to formula (4) to formula (6), according to the center frequency of the antenna, the number of second core layer lamellas (namely thickness of the second core layer) is rationally designed, so that the metamaterial sub-reflector FF has an electromagnetic wave reflection characteristic similar to that of a rotating ellipsoid, that is, an electromagnetic wave obtained after an electromagnetic wave radiated by the far focus F2 (namely the phase center) is reflected by the metamaterial sub-reflector FF passes through the near focus F1.

In summary, if the near focus F1 is designed as the focus of the metamaterial main reflector, the electromagnetic wave can be emerged in a form of a plane wave after being reflected by the metamaterial sub-reflector for a first time and the metamaterial main reflector for a second time; vice verse, that is, an incident plane electromagnetic wave perpendicular to the metamaterial main reflector converges at the phase center (namely the far focus F2) of the feed source after being reflected by the metamaterial sub-reflector for a first time and the metamaterial main reflector for a second time.

In the embodiment of the disclosure, preferably, a shape and area of the metamaterial sub-reflector are adapt to a shape and area of the main reflector, namely as shown in FIG. 1, so that the electromagnetic wave emerged from an edge of the metamaterial sub-reflector exactly reaches an edge of the metamaterial main reflector.

In the embodiment of the disclosure, as shown in FIG. 3 and FIG. 4, the first base material JC1 includes a lamellar first front substrate 13 and a first rear substrate 15, the multiple first conductive geometric structures JG1 are disposed between the first front substrate 13 and the first rear substrate 15, the first core layer lamella is 0.21-2.5 mm in thickness, the first front substrate is 0.1-1 mm in thickness, the first rear substrate is 0.1-1 mm in thickness, and the multiple first conductive geometric structures are 0.01-0.5 mm in thickness.

As an example, the first core layer lamella is 0.818 mm in thickness, the first front substrate and the first rear substrate are both 0.4 mm in thickness, and the multiple first conductive geometric structures are 0.018 mm in thickness.

In the embodiment of the disclosure, as shown in FIG. 12 and FIG. 13, the second base material JC2 includes a lamellar second front substrate 14 and a second rear substrate 16, the multiple second conductive geometric structures JG2 are disposed between the second front substrate 14 and the second rear substrate 16, the second core layer lamella is 0.21-2.5 mm in thickness, the second front substrate is 0.1-1 mm in thickness, the second rear substrate is 0.1-1 mm in thickness, and the multiple second conductive geometric structures are 0.01-0.5 mm in thickness.

As an example, the second core layer lamella is 0.818 mm in thickness, the second front substrate and the second rear substrate are both 0.4 mm in thickness, and the second multiple conductive geometric structures are 0.018 mm in thickness.

After thickness of the first core layer lamella and thickness of the second core layer lamella are determined, the number of layers can be determined as required, so as to form a first core layer with $d_1$ thickness and a second core layer with $d_2$ thickness.

In the embodiment of the disclosure, the first base material and the second base material may be made from materials such as ceramics, polystyrene, polypropylene, polyimide, polyethylene, polyether ether ketone or polytetrafluoroethylene. For example, a polytetrafluoroethylene plate (PS plate) enjoys optimal electrical insulation performance, generates no interference on an electric field of an electromagnetic wave, and features outstanding chemical stability, corrosion resistance, and an extended service life.

In the embodiment of the disclosure, preferably, the first conductive geometric structure and the second conductive geometric structure are both a metallic geometric structure, where the metallic geometric structure consists of one or multiple metal wires, the wires are copper wires, silver wires, or aluminium wires, and the multiple first conductive geometric structures on the first base material are obtained by means of etching, electroplating, drilling, photolithography, electronic engraving, or ion engraving. For example, in terms of the first core layer lamella 10 shown in FIG. 4, one of the first front substrate 13 or first rear substrate 15 is first coated with copper, then unnecessary copper is removed through a technique such as etching so as to obtain planar distribution of the multiple first conductive geometric structures JG1, and finally the first front substrate 13 and the first rear substrate 15 are glued together by using a hot melt adhesive to form the core layer lamella 10. Multiple first core layer lamellas 10 can be formed by using the foregoing method, and a first core layer 101 of a multi-layer structure is obtained by using a hot melt adhesive to glue each first core layer lamella 10. Materials of the hot melt adhesive may be better consistent with materials of the first core layer lamella.

The second core layer lamella and the second core layer can be obtained by using the foregoing method.

In the embodiment of the disclosure, preferably, the multiple first conductive geometric structures of the first base material and the multiple second conductive geometric structures of the second base material all evolve from a topological diagram of a planar snowflake-like metallic geometric structure shown in FIG. 5. That is, the topological diagram of the planar snowflake-like metallic geometric structure shown in FIG. 5 is a basic planar topological diagram of a planar snowflake-like metallic geometric structure, and topological diagrams of all metallic geometric structures of a same first base material and second base material all evolve from the diagram shown in FIG. 5.

As shown in FIG. 5, the planar snowflake-like metallic geometric structure has a first metal wire J1 and a second metal wire J2 that bisect each other perpendicularly, the first metal wire J1 and the second metal wire J2 are of equal length, two ends of the first metal wire J1 are connected with two first metal branches F1 of equal length, the two ends of the first metal wire J1 are connected to midpoints of the two first metal branches F1, two ends of the second metal wire J2 are connected with two second metal branches F2 of equal length, the two ends of the second metal wire J2 are connected to midpoints of the two second metal branches F2, and the first metal branch F1 and the second metal branch F2 are of equal length.

FIG. 6 is a derived structure of the planar snowflake-like metallic geometric structure shown in FIG. 5. Both ends of each first metal branch F1 and each second metal branch F2 of the derived planar snowflake-like metallic geometric structure are both connected with two third metal branches F3 that are totally the same, and corresponding midpoints of the third metal branches F3 are respectively connected to endpoints of the first metal branch F1 and the second metal branch F2. By analogy, other types of metallic geometric structures can be derived from the embodiment of the disclosure. Similarly, the diagram shown in FIG. 6 is only a basic planar topological diagram.

FIG. 7 shows a deformed structure of the planar snowflake-like metallic structure shown in FIG. 5. In this type of metallic structure, the first metal wire J1 and the second metal wire J2 are not straight lines but meander lines, the first metal wire J1 and the second metal wire J2 are both set with two bending parts WZ, but the metal wire J1 and the second metal wire J2 still bisect each other perpendicularly. By setting directions of the bending parts and relative positions of the bending parts in the first metal wire and the second metal wire, a figure, obtained by rotating the metallic geometric structure shown in FIG. 7 by 90 degrees along any direction perpendicular to an axis of an intersection point of the first metal wire and the second metal wire, coincides with an original figure. In addition, another deformation may also be available, for example, the first metal wire J1 and the second metal wire J2 are separately disposed with multiple bending parts WZ. Similarly, the diagram shown in FIG. 7 is only a basic planar topological diagram.

It is known that, the refractive index is $n=\sqrt{\mu\in}$, where μ is relative magnetic conductivity, ∈ is a relative permittivity, and μ and ∈ are jointly called an electromagnetic parameter. It is testified that, when an electromagnetic wave passes through a dielectric material with uneven refractive indexes, the electromagnetic wave deviates to a direction of a larger refractive index. In the case of a specific relative magnetic conductivity (usually close to 1), a refractive index is related to a permittivity only. In the case of a determined first base material, any value (in a certain range) of a refractive index of a metamaterial unit can be implemented by using a first conductive geometric structure that is responsive only to an electromagnetic field. Under a center frequency of the antenna, a condition of change, along with refractive index change of a topological diagram, of a permittivity of a certain-shape conductive geometric structure (the planar snowflake-like metallic geometric structure shown in FIG. 5) can be obtained by using simulation software such as CST, MATLAB, and COMSOL. That is, data of correspondence may be obtained, that is, our required first core layer lamella with specific refractive index distribution can be designed. Similarly, our required second core layer lamella with specific refractive index distribution can be designed.

In the embodiment, planer distribution of first conductive geometric structures on a first core layer lamella may be obtained by means of computer simulation (for example, CST simulation). Specific steps are as follows:

(1) Determine a first base material attached on a first conductive geometric structure. For example, a dielectric substrate whose permittivity is 2.7 and whose material can be FR-4, F4b, or PS is determined (2) Determine dimensions of a metamaterial unit. The dimensions of the metamaterial unit are obtained according to a center frequency of the antenna. A wavelength of the metamaterial unit is obtained according to the frequency, a numeric value less than ⅕ of the wavelength is used as length CD and width KD of a metamaterial unit D, and then a numeric value less than 1/10 of the wavelength is used as thickness of the metamaterial unit D. For example, for an 11.95 G antenna center frequency, the metamaterial unit D is a square plate that is shown in FIG. 2, whose length CD and width KD are both 2.8 mm, and whose thickness HD is 0.543 mm.

(3) Determine a material and basic planar topological diagram of the first conductive geometric structure. In the embodiment of the disclosure, the first conductive geometric structure is a metallic geometric structure, and a material of the metallic geometric structure is copper, a topological diagram of a basic planar topological diagram of the metallic geometric structure is a planar snowflake-like metallic geometric structure shown in FIG. 5, and the metallic geometric structure has an equal line width W in each part. The basic planar topological diagram herein is a basis on which topological diagrams of all conductive geometric structures on a same first base material evolve.

(4) Determine parameters of the topological diagram of the first conductive geometric structure. As shown in FIG. 5, in the embodiment of the disclosure, the parameters of the topological diagram of the planar snowflake-like metallic geometric structure include line width W of the metallic geometric structure, length a of the first metal wire J1, length b of the first metal branch F1, thickness HD of the metallic geometric structure. In the embodiment of the disclosure, the thickness remains unchanged, and takes a value of 0.018 mm.

(5) Determine an evolution restriction condition of the topological diagram of the metallic geometric structure. In the embodiment of the disclosure, an evolution restriction condition of the topological diagram of the metallic geometric structure includes: a minimum spacing WL between metallic geometric structures (as shown in FIG. 5, a distance between a metallic geometric structure and a long side or a wide side of a metamaterial unit is WL/2), a line width W of a metallic geometric structure, and dimensions of a metamaterial unit. Due to a restriction of a processing technique, WL is greater than or equal to 0.1 mm; and likewise, the line width W also needs to be greater than or equal to 0.1 mm. During first simulation, WL may be 0.1 mm, and W may be 0.3 mm, dimensions of a metamaterial unit are that length and width are 2.8 mm, and that thickness is 0.818 mm (the metallic geometric structure is 0.018 mm in thickness, and the base material is 0.8 mm in thickness). In this case, the parameter of the topological diagram of the metallic geometric structure includes only two variables: a and b. For the topological diagram of the metallic geometric structure, in terms of a specific center frequency (for example, 11.95 GHZ), a continuous refractive index change range may be obtained according to an evolution manner shown in FIG. 8 to FIG. 9.

Specifically, evolution of a topological diagram of a metallic geometric structure includes two phases (a basic diagram based on which a topological diagram evolves is the metallic geometric structure shown in FIG. 5):

First phase: According to an evolution restriction condition, change value a from a minimum value to a maximum value in the case that value b keeps unchanged. The metallic geometric structure in the evolution process is of a "cross" shape (except when a is the minimum value). In the embodiment of the disclosure, the minimum value of a is 0.3 mm (a line width W), and the maximum value of a is (CD-WL). Therefore, in the first phase, evolution of the topological diagram of the metamaterial unit is shown in FIG. 8, that is, a maximum "cross" topological diagram JD1 is gradually evolved from a square JX1 with a side length of W. In the first phase, along with the evolution of the topological diagram of the metallic geometric structure, a refractive index of a metamaterial unit corresponding to the metallic geometric structure continuously increases (corresponding to a certain antenna frequency).

Second phase: According to the evolution restriction condition, when a increases to the maximum value, a keeps unchanged. In this case, b is continuously increased to the maximum value from the minimum value. The metallic geometric structure in the evolution process is planar snowflake-like. In the embodiment of the disclosure, the minimum value of b is 0.3 mm (a line width W), and the maximum value of b is (CD-WL-2W). Therefore, in the second phase, evolution of the topological diagram of the metamaterial unit is shown in FIG. 9, that is, a maximum planar snowflake-like topological diagram JD2 is gradually generated from the maximum "cross" topological diagram JD1. The maximum planar snowflake-like topological diagram JD2 herein means that a length b of a first metal branch J1 and a length b of a second metal branch J2 cannot be extended any longer; and otherwise, the first metal branch and the second metal branch are intersected. In the second phase, along with the evolution of the topological diagram of the metallic geometric structure, a refractive index of a metamaterial unit corresponding to the metallic geometric structure continuously increases (corresponding to a certain antenna frequency).

If the refractive index change range of a metamaterial unit obtained though the foregoing evolution includes a continuous change range of $n_{min\ 1}$ to $n_{max\ 1}$ and a continuous change range of $n_{min\ 2}$ to $n_{max\ 2}$, a design demand is met. If the refractive index change range of the metamaterial unit obtained though the foregoing evolution does not meet a design demand, for example, the maximum value is too small or the minimum value is too large, WL and W are modified and simulation is performed again until a refractive index change range required by us is obtained.

According to formulas (1) to (3), after a series of metamaterial units obtained through simulation are distributed according to refractive indexes of the metamaterial units (actually distribution of multiple first conductive geometric structures of various topological diagrams on a base material), the first core layer lamella of the embodiment of the disclosure can be obtained.

Similarly, according to formulas (4) to (6), after a series of metamaterial units obtained through simulation are distributed according to refractive indexes of the metamaterial units (actually distribution of multiple second conductive geometric structures of various topological diagrams on a second base material), a second core layer lamella of the embodiment of the disclosure can be obtained.

The above are merely preferential embodiments of the disclosure and are not intended to limit the disclosure. In terms of persons of ordinary skills in the art, the disclosure may have various modifications and changes. Any modification, equivalent replacement, and improvement made without departing from the spirit and principle of the disclosure shall fall within the protection scope of the disclosure.

What is claimed is:

1. A Cassegrain-type metamaterial antenna, comprising: a metamaterial main reflector having a central through-hole, a feed source disposed in the central through-hole, and a sub-reflector disposed in front of the feed source, wherein an electromagnetic wave radiated by the feed source is emerged after being reflected by the sub-reflector and the metamaterial main reflector in sequence; the metamaterial main reflector comprises: a first core layer and a first reflection layer disposed on a rear surface of the first core layer, wherein the first core layer comprises at least one first core layer lamella, and the first core layer lamella comprises: a first base material and multiple first conductive geometric structures disposed on the first base material; and a far focus of the sub-reflector coincides with a phase center of the feed source; wherein a near focus of the sub-reflector coincides with a focus of the metamaterial main reflector; and the sub-reflector is a curved surface of a rotating two-sheet hyperboloid or a rotating ellipsoid; and a real axis of the rotating two-sheet hyperboloid or the rotating ellipsoid is perpendicular to the metamaterial main reflector;

wherein refractive index distribution of any one of the first core layer lamella meets the following formulas:

$$n(R) = n_{max1} - \frac{\sqrt{s^2 + R^2} - (s + k\lambda)}{2d_1};$$

$$d_1 = \frac{\lambda}{2(n_{max1} - n_{min1})};$$

-continued $$k = \text{floor}\left(\frac{\sqrt{s^2 + R^2} - s}{\lambda}\right);$$

wherein n(R) indicates a refractive index value when a radius of the first core layer lamella is R, and a center of a circle of refractive index distribution of the first core layer lamella is an intersection point of the real axis of the rotating two-sheet hyperboloid or the rotating ellipsoid and the first core layer lamella, or a center of a circle of refractive index distribution of the first core layer lamella is an intersection point of the central axis of the metamaterial sub-reflector and the first core layer lamella;

s indicates a distance from the near focus to a front surface of the metamaterial main reflector:

$d_1$ indicates a thickness of the first core layer;

$n_{max1}$ indicates a maximum refractive index value of the first core layer lamella;

$n_{min1}$ indicates a minimum refractive index value of the first core layer lamella;

λ indicates a wavelength of an electromagnetic wave corresponding to a center frequency of an antenna; and floor indicates rounding down.

2. The Cassegrain-type metamaterial antenna according to claim 1, wherein the sub-reflector is a metamaterial sub-reflector, the metamaterial sub-reflector comprises a second core layer and a second reflection layer disposed on a rear surface of the second core layer, wherein the second core layer comprises at least one second core layer lamella, and the second core layer lamella comprises a second base material and multiple second conductive geometric structures disposed on the second base material, and the metamaterial sub-reflector has an electromagnetic wave reflection characteristic similar to that of a rotating two-sheet hyperboloid or a rotating ellipsoid.

3. The Cassegrain-type metamaterial antenna according to claim 2, wherein a central axis of the metamaterial sub-reflector coincides with a central axis of the metamaterial main reflector.

4. The Cassegrain-type metamaterial antenna according to claim 1, wherein the feed source is a corrugated horn, and the real axis passes through a center of an aperture of the corrugated horn.

5. The Cassegrain-type metamaterial antenna according to claim 3, wherein the feed source is a corrugated horn, and the central axis of the metamaterial sub-reflector passes through a center of an aperture of the corrugated horn.

6. The Cassegrain-type metamaterial antenna according to claim 1, wherein when the sub-reflector is a metamaterial sub-reflector, and the metamaterial sub-reflector has an electromagnetic wave reflection characteristic similar to that of a rotating ellipsoid, refractive index distribution of any one of the second core layer lamella meets the following formulas:

$$n(r) = n_{max2} - \frac{\sqrt{r^2 + a^2} + \sqrt{r^2 + b^2} - (a + b + k\lambda)}{2d_2};$$

$$d_2 = \frac{\lambda}{2(n_{max2} - n_{min2})};$$

-continued $$k = \text{floor}\left(\frac{\sqrt{r^2 + a^2} + \sqrt{r^2 + b^2} - (a + b)}{\lambda}\right);$$

wherein, n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max2}$ indicates a maximum refractive index value of the second core layer lamella;

$n_{min2}$ indicates a minimum refractive index value of the second core layer lamella;

λ indicates the wavelength of the electromagnetic wave corresponding to the center frequency of the antenna;

a indicates a perpendicular distance from the far focus of the metamaterial sub-reflector to the metamaterial sub-reflector;

b indicates a perpendicular distance from the near focus of the metamaterial sub-reflector to the metamaterial sub-reflector; and floor indicates rounding down.

7. The Cassegrain-type metamaterial antenna according to claim 1, wherein when the sub-reflector is a metamaterial sub-reflector, and the metamaterial sub-reflector has an electromagnetic wave reflection characteristic similar to that of a rotating two-sheet hyperboloid, refractive index distribution of any one of the second core layer lamella meets the following formulas:

$$n(r) = n_{min2} + \frac{Gz - Gr - k\lambda}{2d_2};$$

$$d_2 = \frac{\lambda}{2(n_{max2} - n_{min2})};$$

$$k = \text{floor}\left(\frac{Gz - Gr}{\lambda}\right);$$

$$Gz = a + (L - b);$$

$$Gr = \sqrt{r^2 + a^2} + \left(L - \sqrt{r^2 + b^2}\right);$$

wherein, n(r) indicates a refractive index value when a radius of the second core layer lamella is r, and a center of a circle of refractive index distribution of the second core layer lamella is an intersection point of the central axis of the metamaterial sub-reflector and the second core layer lamella;

$d_2$ indicates a thickness of the second core layer;

$n_{max2}$ indicates a maximum refractive index value of the second core layer lamella;

$n_{min2}$ indicates a minimum refractive index value of the second core layer lamella;

λ indicates the wavelength of the electromagnetic wave corresponding to the center frequency of the antenna;

a indicates a perpendicular distance from the far focus of the metamaterial sub-reflector to the metamaterial sub-reflector;

b indicates a perpendicular distance from the near focus of the metamaterial sub-reflector to the metamaterial sub-reflector;

L indicates a maximum value of a radius of the second core layer lamella; and floor indicates rounding down.

8. The Cassegrain-type metamaterial antenna according to claim 2, wherein the first base material includes a lamellar first front substrate and a first rear substrate, the multiple first conductive geometric structures are disposed between the first front substrate and the first rear substrate, the second base material comprises a lamellar second front substrate and a second rear substrate, the multiple second conductive geometric structures are disposed between the second front substrate and the second rear substrate; the first core layer lamella and the second core layer lamella are 0.21-2.5 mm in thickness, the first front substrate and the second front substrate are 0.1-1 mm in thickness, the first rear substrate and the second rear substrate are 0.1-1 mm in thickness, and the multiple first conductive geometric structures and the multiple second conductive geometric structures are 0.01-0.5 mm in thickness.

9. The Cassegrain-type metamaterial antenna according to claim 8, wherein the first core layer lamella is 0.818 mm in thickness, the first front substrate and the first rear substrate are both 0.4 mm in thickness, and the multiple first conductive geometric structures are 0.018 mm in thickness.

10. The Cassegrain-type metamaterial antenna according to claim 1, wherein the first conductive geometric structure is a metallic geometric structure, and the metallic geometric structure consists of one or multiple metal wires, the wires are copper wires, silver wires, or aluminium wires, and the multiple first conductive geometric structures on the first base material are obtained by means of etching, electroplating, drilling, photolithography, electronic engraving, or ion engraving.

11. The Cassegrain-type metamaterial antenna according to claim 2, wherein the first conductive geometric structure and the second conductive geometric structure are both a metallic geometric structure, and the metallic geometric structure consists of one or multiple metal wires, the wires are copper wires, silver wires, or aluminium wires, and the multiple first conductive geometric structures on the first base material and the multiple second conductive geometric structures on the second base material are obtained by means of etching, electroplating, drilling, photolithography, electronic engraving, or ion engraving.

12. The Cassegrain-type metamaterial antenna according to claim 10, wherein the multiple first conductive geometric structures of the first base material evolve from a topological diagram of a planar snowflake-like metallic geometric structure, the planar snowflake-like metallic geometric structure has a first metal wire and a second metal wire that bisect each other perpendicularly, the first metal wire and the second metal wire are of equal length, two ends of the first metal wire are connected with two first metal branches of equal length, the two ends of the first metal wire are connected to midpoints of the two first metal branches, two ends of the second metal wire are connected with two second metal branches of equal length, the two ends of the second metal wire are connected to midpoints of the two second metal branches, and the first metal branch and the second metal branch are of equal length.

13. The Cassegrain-type metamaterial antenna according to claim 11, wherein the multiple first conductive geometric structures of the first base material and the multiple second conductive geometric structures of the second base material all evolve from a topological diagram of a planar snowflake-like metallic geometric structure, the planar snowflake-like metallic geometric structure has a first metal wire and a second metal wire that bisect each other perpendicularly, the first metal wire and the second metal wire are of equal length, two ends of the first metal wire are connected with two first metal branches of equal length, the two ends of the first metal wire are connected to midpoints of the two first metal branches, two ends of the second metal wire are connected with two second metal branches of equal length, the two ends of the second metal wire are connected to midpoints of the two second metal branches, and the first metal branch and the second metal branch are of equal length.

14. The Cassegrain-type metamaterial antenna according to claim 12, wherein both ends of each first metal branch and each second metal branch of the planar snowflake-like metallic geometric structure are further connected with two third metal branches that are totally the same, and corresponding midpoints of the third metal branches are respectively connected to endpoints of the first metal branch and the second metal branch; or the first metal wire and the second metal wire of the planar snowflake-like metallic geometric structure are both set with two bending parts, and a figure, obtained by rotating the planar snowflake-like metallic geometric structure by 90 degrees around an intersection point of the first metal wire and the second metal wire in a plane where the planar snowflake-like metallic geometric structure is located, coincides with an original figure.

15. The Cassegrain-type metamaterial antenna according to claim 13, wherein both ends of each first metal branch and each second metal branch of the planar snowflake-like metallic geometric structure are further connected with two third metal branches that are totally the same, and corresponding midpoints of the third metal branches are respectively connected to endpoints of the first metal branch and the second metal branch; or the first metal wire and the second metal wire of the planar snowflake-like metallic geometric structure are both set with two bending parts, and a figure, obtained by rotating the planar snowflake-like metallic geometric structure by 90 degrees around an intersection point of the first metal wire and the second metal wire in a plane where the planar snowflake-like metallic geometric structure is located, coincides with an original figure.

* * * * *